United States Patent [19]

Stirbis

[11] Patent Number: 4,498,387

[45] Date of Patent: Feb. 12, 1985

[54] CAM ASSEMBLY FOR SKIP-PRINT MANDREL WHEEL ASSEMBLY

[75] Inventor: James S. Stirbis, Littleton, Colo.

[73] Assignee: Adolph Coors Company, Golden, Colo.

[21] Appl. No.: 544,015

[22] Filed: Oct. 21, 1983

[51] Int. Cl.[3] ..... B41F 17/22

[52] U.S. Cl. ..... 101/40; 74/568 R

[58] Field of Search ..... 101/39, 40, 38 A, 38 R; 74/567, 568 R

[56] References Cited

U.S. PATENT DOCUMENTS

| | | | |
|---|---|---|---|
| 3,496,863 | 2/1970 | Cvacho et al. | 101/40 |
| 3,851,579 | 12/1974 | Zurick | 101/39 |
| 4,018,151 | 4/1977 | Urban et al. | 101/40 |
| 4,140,053 | 2/1979 | Skrypek et al. | 101/40 |

*Primary Examiner*—Clifford D. Crowder

*Attorney, Agent, or Firm*—Klaas & Law

[57] ABSTRACT

A mandrel assembly for use in a machine for continuous printing of cylindrical containers, comprising a mandrel wheel; mandrel holders, pivotally mounted on circumferential portions of the mandrel wheel; elongate mandrels for supporting cylindrical containers on peripheral surfaces thereof, rotatably mounted on the mandrel holder and radially displaceable relative the central axis of rotation of the mandrel wheel; a cam follower rotatably mounted on each mandrel holder; and a cam track assembly operably associated with the cam followers for causing preselected radial displacement of the cam followers with respect to the central axis of rotation of the mandrel wheel which in turn causes preselected radial displacement of associated mandrel spindles relative a blanket wheel device to either cause a container to be printed or to be skipped from printing.

19 Claims, 23 Drawing Figures

CAM ASSEMBLY FOR SKIP-PRINT MANDREL WHEEL ASSEMBLY

BACKGROUND OF THE INVENTION

The present invention relates to a high speed continuous decorator machine for decorating cylindrical containers such as can bodies and, more specifically, relates to a mandrel wheel assembly comprising apparatus for moving a mandrel spindle having an improperly seated can or no can thereon out of printing relationship with an associated blanket wheel to avoid printing of the mandrel spindle exterior surface.

Can printing (decorating) machines, especially high speed continuous can printing machines, operate by the impingement of a rotating, image-carrying blanket wheel and an oppositely rotating can carrying mandrel wheel assembly. The blanket wheel comprises an endless blanket which is at least as wide as the length of the cans being printed. The blanket carries a series of wet ink images circumferentially spaced on its resilient periphery. The mandrel wheel assembly comprises a mandrel wheel mounted with a series of circumferentially spaced, rotatable mandrel spindles over which cans are fitted. The cans rotate on the mandrel wheel into registry and contact with the images on the surface of the blanket wheel. Each mandrel spindle generally includes structure for removing cans from or drawing cans onto the mandrel spindle.

During high speed can printing, a can will occasionally fail to properly seat on a mandrel spindle or a gap will occur in the continuous can infeed to the machine causing one or more mandrel spindles not to have a can received thereon. In such circumstances, it is necessary that the mandrel spindle not be moved into contact with the blanket wheel to prevent the mandrel spindle surface from being printed. A number of different mechanisms have been utilized in the past to provide such a "skip-print" feature.

Hartmeister et al., U.S. Pat. No. 3,655,853 issued May 30, 1972 describes a continuous printer and skip-printer mechanism comprising a plurality of blanket holder segments on a rotated drum successively movable into and out of printing position, a stationary cam, a cam follower on each segment, and operative connections including a withdrawable bridge member between the cam follower and each blanket holder segment for moving the segment into printing position. An air cylinder responsive to a malfunction signal actuates a pivotally mounted trigger and connecting rod which are part of skip-print means for withdrawing the bridging member from the operative connections between the cam follower and each blanket holder segment, thereby producing a gap in the operative connections and preventing movement of the segment into printing position when malfunction occurs, without interrupting subsequent printing operations.

Zurick, U.S. Pat. No. 3,851,579 issued Dec. 3, 1974 describes a trip mechanism for a continuously rotating can printing or coating machine having rotatable can shaft supports, which is operable to displace the support from a print blanket. The trip mechanism includes an eccentric sleeve between the shaft and a bore which is rotatable with the bore and about the shaft. In a normal position, the sleeve holds the shaft in position to effect contact between a can mounted thereon and the print blanket. A detector provides a trip signal in response to the absence of a can. A trip cam and trip cam follower pair are provided, one of which is mounted on the eccentric sleeve. The trip cam is thrown from a normal print to a trip position in response to a trip signal. The trip pair is positioned to engage one another when the cam is in the trip position to cause rotation of the sleeve whereby the shaft and can support are displaced away from the print blanket.

Sirvet, U.S. Pat. No. 4,037,530 issued July 26, 1977 describes a pocket mandrel wheel having mandrels mounted on mandrel spindles that pivot to move the mandrels laterally to prevent the mandrels from contacting an associated printing wheel. The mandrel spindles are attached to the mandrel wheel by a pivot arm that controls the radius of the mandrels line of motion as the mandrel wheel rotates. The pivot arm causes the mandrel spindle to rotate the mandrel in response to an electronic system that detects improperly seated cans on the mandrels. The pivot arm rests against an interposer block having a recessed step, and the mandrel is withdrawn when the block is moved in response to a signal from the electronic system so that the pivot are rests against the recessed portion of the block. The movement of the block is controlled by a mechanical system that moves the pivot are away from the block prior to the time when the mandrel may be tripped.

The prior art designs, because of the relatively large number of moving parts, have proven to be expensive to construct and to maintain. The numerous moving parts of such prior art designs also create dimensional tolerance related problems in a system where registry between a can carrying mandrel spindle and image carrying blanket wheel must be exact. Yet another problem with prior art designs has been that the trip mechanism for the skip-print system must be actuated prior to the time that a mandrel spindle is in the immediate vicinity of the blanket wheel in order for the skip-print system to have sufficient time to move the mandrel spindle from its ordinary, blanket wheel contacting path to a path which is spaced apart form the blanket wheel. In such a system, the detection device which senses the absence of a can or an improperly seated can on a mandrel spindle is necessarily positioned a substantial distance "upstream" of the blanket wheel contact area. As a result of this upstream positioning such a detection device cannot sense a can which becomes unseated from a mandrel spindle at a point downstream of the detection device but upstream of the blanket wheel contact area. In extremely high speed machines this problem is accentuated because the detection device "looks at" a can/mandrel spindle seating arrangement prior to the time that the can seating (transfer of the can body from a pocket opposite a mandrel spindle to the mandrel spindle) is completed. Thus the seating detection device is required to predict whether or nor a given can will seat on a mandrel spindle, rather than actually observing the proper seating or lack of proper seating. Since such "predictions" are necessarily less accurate than an observation of the can/mandrel spindle seating arrangement immediately prior to contact of the can with the blanket wheel, misseated cans are occasionally printed. Such printing results in an improper image transfer known in the trade as "partial litho". Similarly, cans which are properly seated on the mandrels are occasionally not printed because of an erroneous prediction by the seating detection device.

Another problem encountered with a number of existing mandrel spindle skip-print mechanisms is that, due to relatively infrequent operation of the skip-print mechanism within an otherwise dynamic system, the bearings of certain parts associated with the skip-print mechanism deteriorate through a phenomenon known as "bernelling" or "fretting corrosion".

It would be generally desirable to provide a mandrel wheel assembly which prevents a mandrel spindle from engaging a blanket wheel except when a can body is properly seated thereon. It would also be desirable to provide a mandrel wheel assembly which provides accurate registry between can bodies and a blanket wheel and which is relatively inexpensive to adjust and maintain as compared to existing mandrel wheel assemblies. It would further be desirable to provide a mandrel wheel assembly which allows relatively longer loading time for seating a can body on a mandrel spindle than present machines without decreasing machine operating speeds. It would still further be desirable to provide a mandrel wheel assembly having highly accurate can seating detection apparatus. It would yet further be desirable to provide a mandrel wheel assembly with a skip-print apparatus which is not subject to bernelling.

SUMMARY OF THE INVENTION

The present invention is a mandrel assembly for use in a continuous printing machine for cylindrical containers comprising: mandrel wheel means for supporting cylindrical container receiving apparatus thereon, the mandrel wheel means having a central axis of rotation positioned in parallel alignment with a central axis of rotation of an associated blanket wheel device carrying a printing medium on a circumferential portion thereof for printing on the cylindrical containers carried by the mandrel wheel; at least one mandrel holder means for supporting a mandrel spindle means thereon, pivotally mounted on a circumferential portion of the mandrel wheel means for pivotal movement about a mandrel holder pivot axis positioned substantially parallel to the mandrel wheel central axis of rotation; elongate mandrel spindle means for supporting a cylindrical container on a peripheral surface thereof, rotatably mounted on the mandrel holder means for rotation about a central axis of rotation positioned in substantially parallel, non-coaxial relationship with the mandrel holder pivot axis whereby the mandrel spindle means is radially displaceable relative the central axis of rotation of the mandrel wheel means by pivotal movement of the mandrel holder means about the mandrel holder pivot axis; cam follower means for following a cam track means, rotatably mounted on the mandrel holder means for rotation about a central axis of rotation positioned in substantially parallel, non-coaxial relationship with the mandrel holder pivot axis whereby the mandrel holder means is pivotally displaced about the mandrel holder means pivot axis by radial displacement of the cam follower means relative the central axis of rotation of the mandrel wheel means; cam track means operably associated with the cam follower means for guiding the cam follower means and for causing relative radial displacement thereof with respect to the central axis of rotation of said mandrel wheel means for causing radial displacement of the mandrel spindle means relative the blanket wheel device in response to a control signal, whereby when the mandrel wheel means is in a rotated position associated with cylindrical container printing, and when the mandrel spindle is in a normal operating state wherein the mandrel spindle has a cylindrical container properly seated thereon, the mandrel spindle is positioned to urge the cylinder container into printing contact with the blanket wheel device; and whereby when said mandrel wheel means is in the rotated position associated with cylindrical container printing and when the mandrel spindle is in a skip-print operating state wherein the mandrel spindle does not have a cylindrical container properly seated thereon, the mandrel spindle is positioned in radially spaced apart, non-engaging relationship with the blanket wheel device.

It is an object of the present invention to provide a mandrel wheel assembly which prevents a mandrel spindle from engaging a blanket wheel except when a can body is properly seated thereon.

It is an object of the present invention to provide a mandrel wheel assembly which provides accurate registry between can bodies and a blanket wheel and which is relatively inexpensive to adjust and maintain as compared to existing mandrel wheel assemblies.

It is an object of the present invention to provide a mandrel wheel assembly which allows relatively longer loading time for seating a can body on a mandrel spindle than present machines without decreasing machine operating speeds.

It is an object of the present invention to provide a mandrel wheel assembly having highly accurate can seating detection apparatus.

It is an object of the present invention to provide a mandrel wheel assembly with a skip-print apparatus which is not subject to bernelling.

BRIEF DESCRIPTION OF THE DRAWINGS

An illustrative and presently preferred embodiment of the invention is shown in the accompanying drawings in which.

DESCRIPTION OF THE PREFERRED EMBODIMENT

In General

Figure 1:
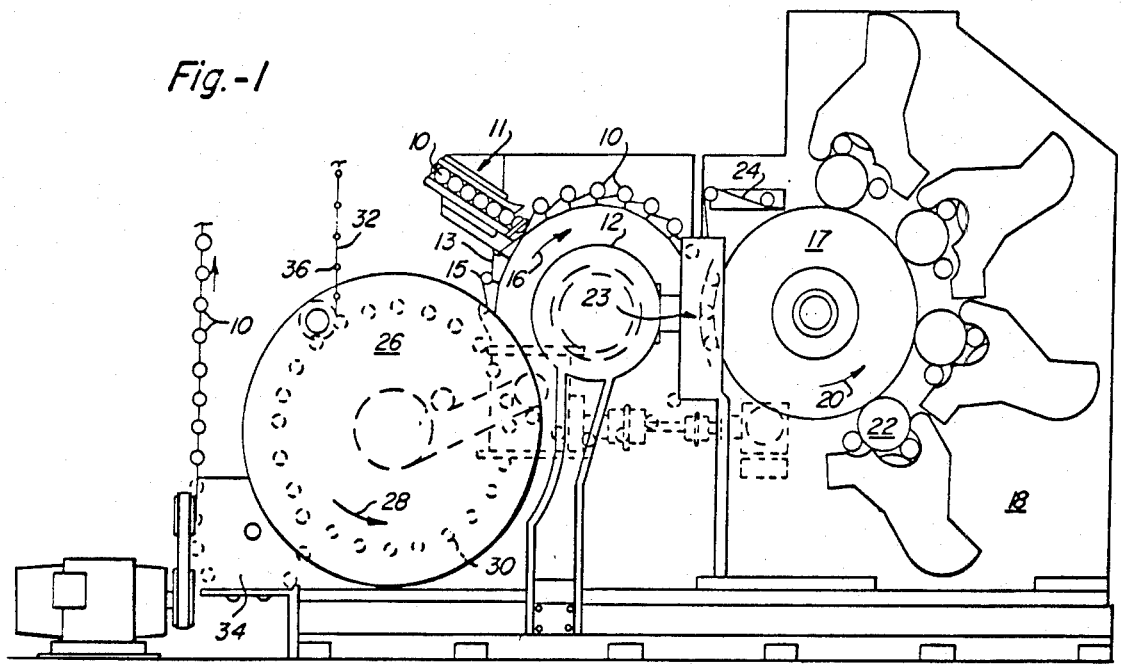
FIG. 1 is a schematic view illustrating the operation of a high-speed continuous can decorating machine.

Referring now to FIG. 1, a conventional high speed continuous can printer is shown wherein cans 10 are fed through an infeed chute 11 to a pocket wheel 12 comprising a plurality of pockets 13 circumferentially arranged about a mandrel wheel. Each pocket has a concave semi-cylindrical surface in which cans rest and are retained by gravity. The mandrel wheel also has a plurality of mandrels 15 which approximate the internal diameter of the cans 10 and which are axially aligned with the pockets 13 so that cans may be slid from each pocket onto a corresponding mandrel by angled fingers (not shown) and a burst of compressed air. Cans are held against the mandrels by vacuum applied through the mandrels. Each mandrel spindle and can thereon rotates continuously with the mandrel wheel in a generally circular path of travel in the direction of arrow 16 to the vicinity of a printing blanket wheel 17 mounted in radial opposition to the mandrel wheel on a machine stand 18. The blanket wheel 17 is driven in the direction of arrow 20 opposite to the direction of arrow 16 and carries on its periphery a smooth, segmented rubber printing blanket bearing wet reverse ink images to be transferred to the cans. The width of the printing blanket corresponds to the length of the cans. The ink images are placed on the blanket wheel by printing cylinder assemblies 22 mounted on the machine stand 18, there being one printing cylinder assembly and associated ink supply rolls for each color contained in the ink image. In the vicinity of the blanket wheel, the mandrels 15 depart from their circular path of travel and move in a path defined by a cam track in a concave path shown in exaggerated form at 23, in FIG. 1, which corresponds to the circumference of the printing blanket. The printing operation involves contact between the rotating can and a segment of the printing blanket during mandrel movement along the concave portion 23 of the mandrel assembly track.

During the printing operation, a can may be dented or for some other reason not properly seated on a mandrel spindle. In order to prevent contamination of a bare mandrel spindle with ink from the printing blanket, a "skip-print" mechanism is provided to prevent contact of a bare mandrel spindle with the printing blanket as described in greater detail below.

After printing, the cans 10 again follow a circular path of travel at the periphery of the mandrel wheel to a transfer mechanism such as a continuously rotatable transfer wheel 26 mounted for rotation in the direction of arrow 28 parallel to the mandrel wheel and comprising a peripheral array of transfer devices, such as suction cups 30 extending axially towards the mandrels and rotating in cooperation therewith to pass oppositely of the mandrels. The transfer devices 30 are carried on the transfer wheel 26 to an output conveyor chain 32 powered by a chain drive 34 and comprising a plurality of pins 36. The pins 36 extend from the chain towards the cans on the transfer wheel and are spaced and arranged so that each pin enters a can on the transfer wheel and supports the can upon removal of suction from the suction cups 30. The cans 10 on the pins 36 move away from the suction cups and the transfer wheel and are carried to a drying oven for further handling.

In the printing machine illustrated in FIG. 1, can bodies are printed with ink images placed on a single printing blanket. However, it will be apparent to those with skill in the art that the mandrel assembly described below may be utilized for the decorating of any cylindrical container. The decorating process may also include a varnish blanket wheel 19 in addition to a printing blanket wheel 17, as shown schematically in FIG. 7, allowing the containers to be varnished (sealed) immediately after printing. The use of a varnish blanket wheel and a print blanket wheel in association with a single mandrel wheel assembly is well known in the art.

Figure 3:
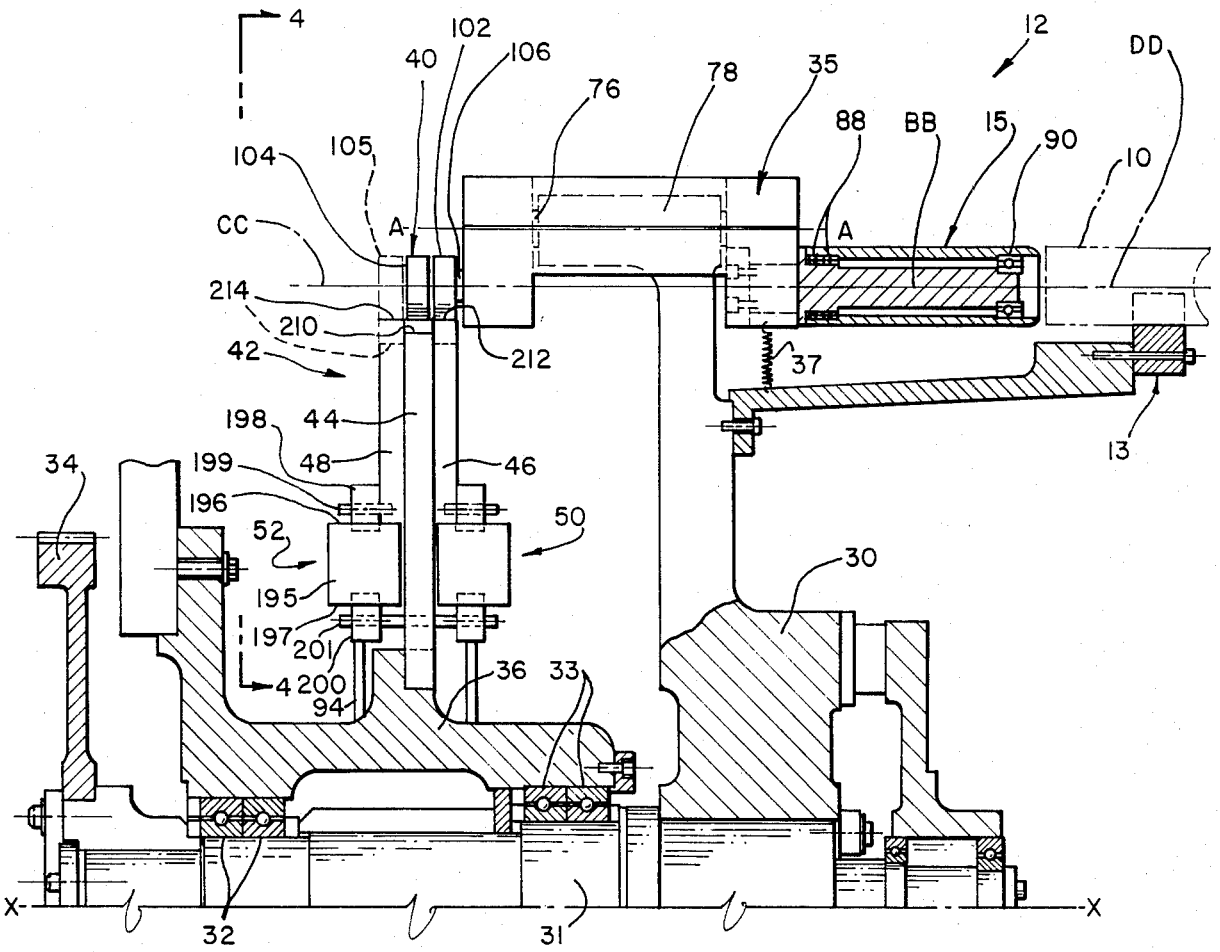
FIG. 3 is a partially cross-sectional elevation view of a mandrel wheel assembly of the present invention.

As best illustrated in FIG. 3, the mandrel wheel assembly of the present invention comprises a turret disc 30 which is keyed to a shaft 31 having a central axis of rotation XX. The shaft 31 is supported on bearings 32 and 33 which are in turn mounted on a fixed structure support 36. The shaft 31 is driven in a continuous rotating motion by gear 34 through an appropriate drive means.

Figure 2:
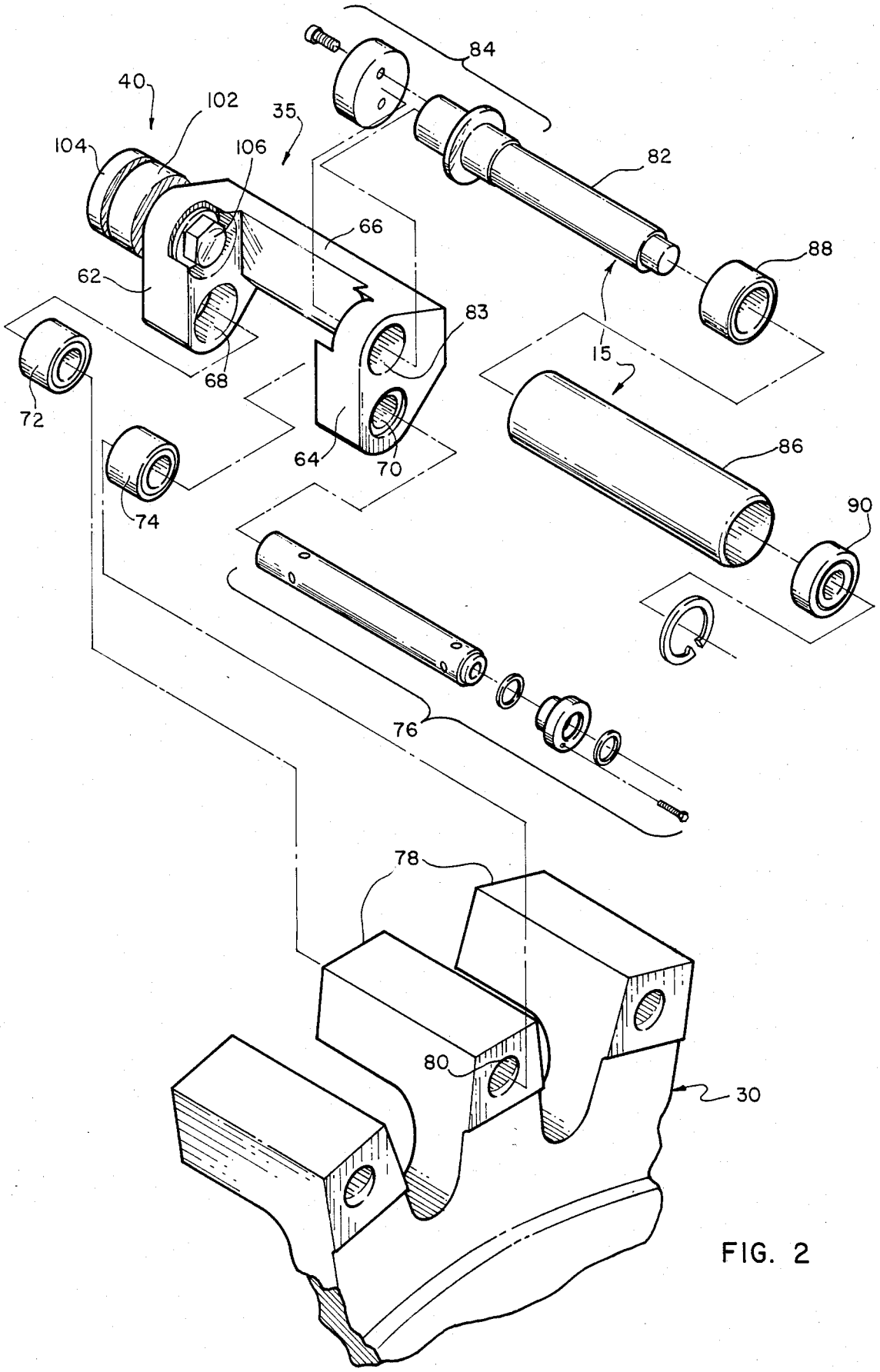
FIG. 2 is an exploded perspective view of a portion of the mandrel assembly of the present invention.

As best shown in FIGS. 2 and 3, each mandrel spindle 15 is pivotally mounted on a mandrel holder 35 which in turn pivots about a mandrel holder central axis of rotation AA. Pivoting motion of the mandrel holder may be induced by a cam follower assembly 40 attached to mandrel holder 35 at a position which may be axially opposite mandrel spindle 15. The mandrel holder 35 is pivotally mounted on a circumferential portion of turret disc 30 as by a pivot pin 76. The mandrel holder central axis of rotation AA is positioned in parallel non-coaxial alignment with mandrel spindle central axis of rotation BB and cam follower central axis of rotation CC. In the preferred embodiment illustrated in the drawing, the mandrel spindle central axis of rotation BB and the cam follower central axis of rotation CC are coaxial. The non-coaxial alignment of axes BB and CC with axis AA permits relative radial displacement of mandrel spindle axis BB with respect to mandrel wheel axis XX by co-action of cam follower means 40 with a cam track assembly means 42 as explained in further detail hereinafter. Mandrel arm central axis BB is coaxially alignable with pocket holder 13 central axis DD as illustrated in FIG. 3 for the purpose of receiving a cylindrical container 10 therefrom by appropriate can transfer means such as axially displaceable fingers (not shown) or vacuum lines positioned within the mandrel spindle 15 (not shown). Such can transfer apparatus and other details of mandrel wheel construction are discussed more fully in Sirvet U.S. Pat. No. 4,037,530 and Stirbis U.S. Pat. No. 4,267,771 which are hereby incorporated by reference for all that is contained therein.

Figure 5:
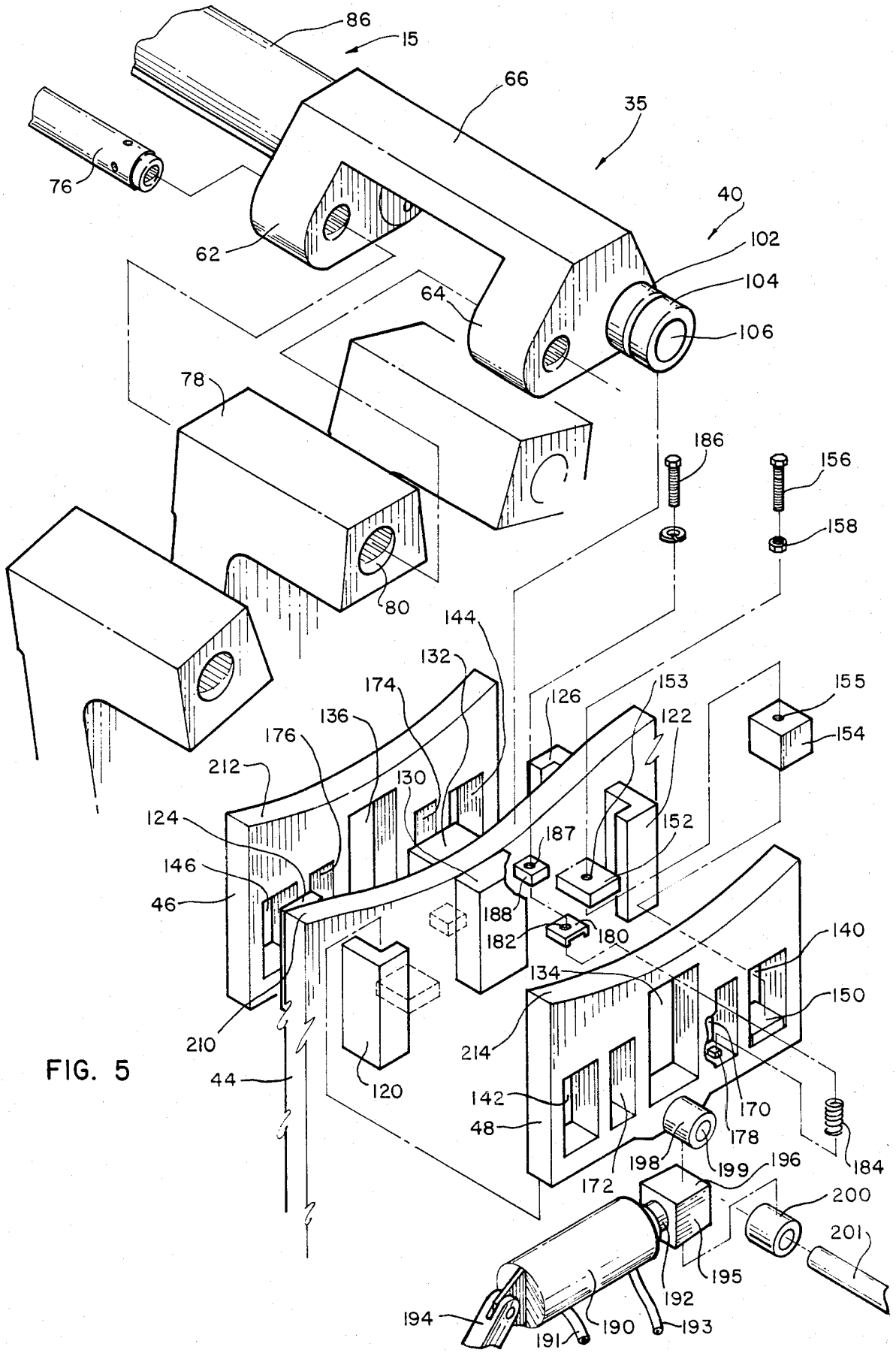
FIG. 5 is an exploded perspective view of a mandrel wheel assembly of the present invention.
Figure 6:
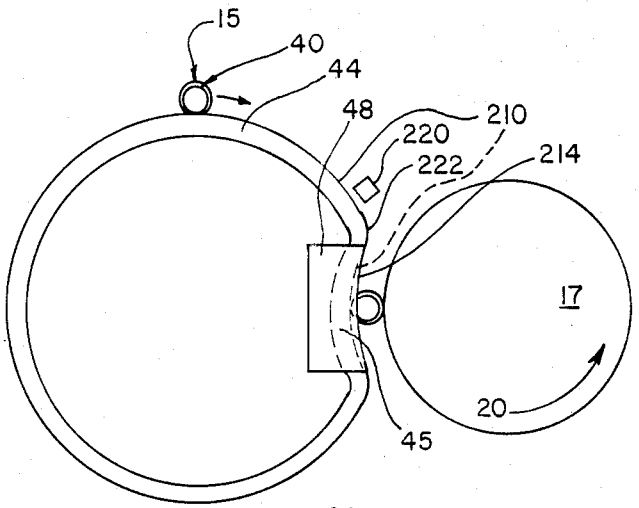
FIG. 6 is a schematic axial view of the mandrel wheel assembly of the present invention.
Figure 7:
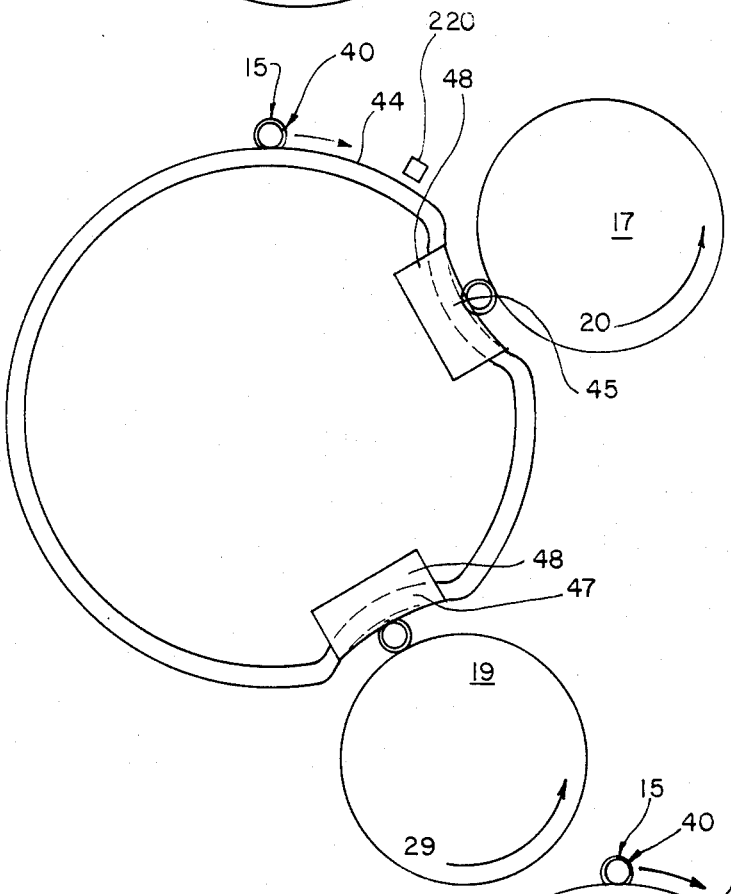
FIG. 7 is a schematic axial view of another embodiment of the mandrel wheel assembly of the present invention.

The cam track assembly means 42 comprises an idler cam track 44 which is fixedly attached to support 36 and which forms a continuous generally circular loop as illustrated in FIG. 6. Cam follower assemblies 40 are biased against a surface of the idler cam track by biasing means such as coil spring 37 attached to the mandrel holder 35 and turret disc 30. The continuous loop formed by the idler cam track 44 has at least one indentation portion 45 and in some embodiments, as illustrated in FIG. 7, a plurality of indentation portions 45, 47. The indentation portions are associated with can printing and cause an inward radial displacement of the cam follower assembly 40 as it rides around the idler cam track loop. This displacement causes a can 10 seated on mandrel spindle 15 which is in turn mounted on an associated mandrel holder 35 to be urged into printing contact with a surface portion of blanket wheel 17 or 19 positioned radially opposite the indentation portions. A first cam plate means 46 positioned adjacent one radial surface of the idler cam track 44 and a second cam plate means 48 positioned adjacent the other radially extending surface of idler cam track 44 are each circumferentially coextensive with the indentation portion 45 of the idler cam track 44, in FIG. 6. In the embodiment illustrated in FIG. 7, a pair of cam plates 46, 48 are mounted at each indentation portion 45, 47. The cam plate means 46, 48 are each independently radially displaceable relative the idler cam track 44 through the use of a first and second cam plate movement means 50, 52, FIG. 3. The radial displacement of a cam plate means relative the idler cam track 44 allows a cam follower 40 to be radially displaced relative its normal path about the idler cam track 44. In the embodiment illustrated in FIGS. 3–8, when a cam plate is positioned radially outwardly, it engages the cam follower and causes normal can printing to occur. When a cam plate is positioned radially inwardly the idler cam track 44 engages the cam follower and skip-printing occurs, i.e. the can carried by the mandrel spindle does not contact the blanket wheel, as described in further detail below. Two cam plate means 46, 48 are used in the preferred embodiment instead of a single cam plate means for system timing purposes. One cam plate 46 is associated with a first set of mandrel holders and spindles, hereinafter "even" mandrel holders and spindles, and the second plate is associated with a second set of mandrel holders and spindles, hereinafter "odd" mandrel holders and arms. The mandrel holders and spindles of the two sets are of essentially identical construction except for the construction of the cam follower means 40. The mandrel holders of the two sets are positioned one after the other in staggered odd-even relationship about the circumference of the mandrel wheel turret disc 30. One set of sensing and actuation apparatus controls the print and skip-print operation of the even mandrel spindles and a second set of sensing and control apparatus controls the print and skip-print operation of the odd mandrel spindles. Although such an odd-even timing system is preferable to a single timing system in high speed machines, the basic skip-print mandrel assembly provided by the present invention is equally applicable to a single timing type arrangement in which a single cam plate rather than a double cam plate assembly is used.

Having thus described the mandrel spindle assembly generally, the various structural components will now be described in detail.

As best illustrated in FIG. 2, mandrel holder 35 is a U-shaped configuration comprising axially spaced apart wing portions 62, 64 which are integrally connected by an axially extending bridge portion 66. Coaxial bores 68, 70 provided in the wing portions 62, 64 accept bearings 72, 74 which in turn accept a mandrel holder pivot pin assembly 76. The pin assembly is used to rotatably mount the mandrel holder 35 on a mandrel wheel connection portion or cog 78 having an axially extending bore 80 therethrough.

A bore 83 positioned in spaced apart, non-coaxial relationship with bore 70 is provided in wing portion 64 for mounting of mandrel spindle means 15. The mandrel spindle means 15 comprises a mandrel spindle central shaft 82 coaxially affixed to a mandrel shaft connection assembly 84 which is in turn fixedly mounted to the mandrel holder through bore 83. A mandrel spindle sleeve 86 is rotatably mounted about mandrel spindle central shaft 82 by mandrel sleeve bearings 88, 90. Thus, the mandrel sleeve 86 is freely rotatable about a central axis BB defined by shaft 82. The mandrel spindle central axis of rotation BB is positioned in offset parallel alignment with mandrel holder central axis AA. In a typical application the offset might be about two inches.

Cam follower means 40, as illustrated in FIG. 3, comprises two cam wheels mounted on a cam wheel shaft 106. In the case of an "even" mandrel holder which is actuated by cam plate 46, the two cam wheels are positioned as indicated by the reference numerals 102 and 104. In the case of an "odd" mandrel holder associated with the second cam plate, the two cam wheels are positioned as indicated by the reference numerals 104, 105. Thus, whether the configuration of a mandrel holder is odd or even, it has one cam wheel 104 positioned immediately above, i.e., radially opposite cam track 44, with the other cam wheel, 102 or 105, positioned immediately above an associated cam plate means 46 or 48.

Cam plate means 46 and the various movement and biasing apparatus associated with it are mirror images of cam plate means 48 and its associated apparatus. Thus, to avoid unnecessary repetition, only cam plate means 48 and its associated equipment is described in detail.

Two L-shaped guide blocks 120, 122 are fixedly mounted as by welding or the like to a radially extending surface portion of cam track 44 and hold cam plate means 48 in slidingly abutting contact with the cam track 44, allowing sliding radial displacement of the cam plate means with respect to the cam track while preventing circumferential or axial displacement. L-shaped guide blocks 124, 126 are similarly attached to the opposite radial side of the cam track 44 to guide cam plate means 46. A key blocks 130, 132 is centrally positioned between each associated pair of L-shaped guide blocks 120, 122 and 124, 126. The radially extending side surfaces of each key block 130, 132 slidingly engage side surfaces of associated cam plate key guide cut out portions 134, 136. The sliding relationship of the key block and key guide cut out surfaces cause the associated cam plate to move along a precise radial path as it is moved radially inwardly or outwardly by the associated cam plate movement means 50, 52.

Figure 4:
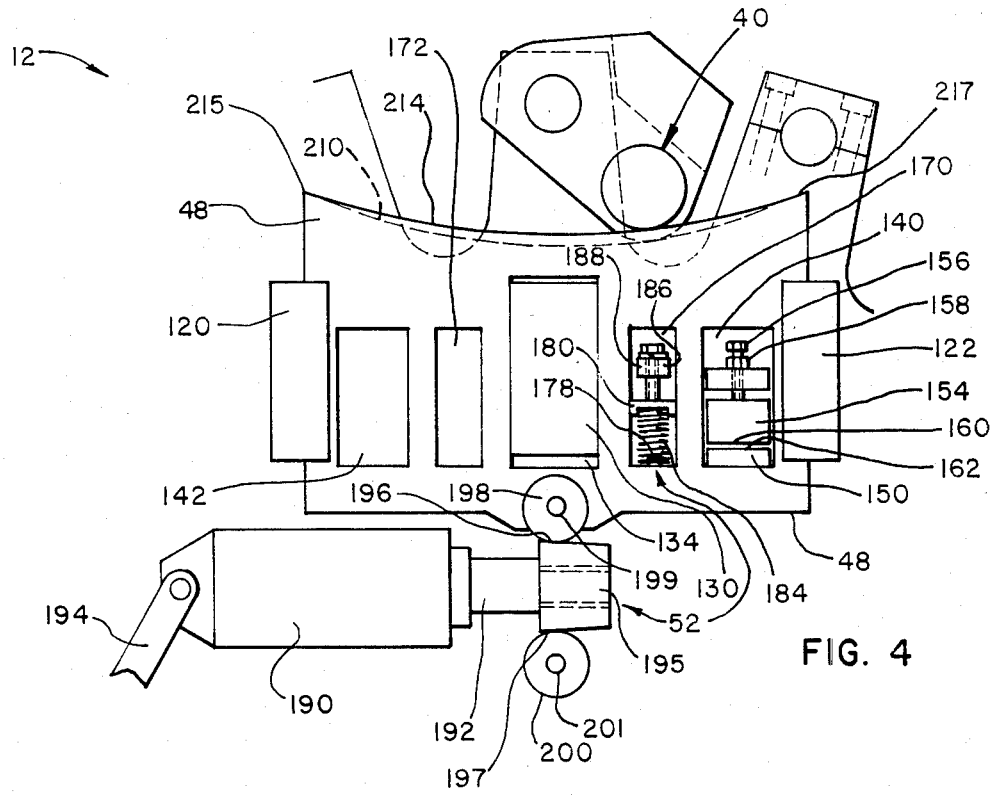
FIG. 4 is an elevation view of a mandrel wheel assembly of the present invention.

Other generally rectangular, radially extending cut out portions 140, 142 in cam plate means 48 and 144, 146 in cam plate means 46 are provided for mounting of displacement limiting apparatus. Only a single set of such apparatus is illustrated in FIGS. 4 and 5 to avoid cluttering the drawing, however, in the preferred embodiment, an identical set of such apparatus is provided in each cut out 140, 142, 144, 146. The displacement limiting means comprises a block 150 which is fixedly attached to the radially inward, circumferentially extending surface of the cut out. A second block 152 is fixedly attached to a radially extending surface of the cam track 44 and extends axially outwardly directly above the cam plate block 150. A threaded bolt 156 which threadingly accepts a lock nut 158 is threadingly mounted in a tapped bore 153 in block 152 and is thus radially adjustable with respect to block 150. A moveable block 154 is journaled to the end of bolt 156 at bored out portion 155. The radially inwardly, axially and circumferentially extending surface 160 of block 154 is thus adjustably displaceable relative the oppositely positioned surface 162 of block 150. The radially upward travel of cam plate means 48 is thus limited by the contact of surface 160 with surface 162 thus allowing the radially outward most position of cam plate means 48 to be precisely adjusted.

As further illustrated by FIGS. 4 and 5, bias apparatus cut outs 170, 172, 174, 176 are provided in associated cam plate means 46, 48. Again, as with the displacement limiting apparatus, only a single set of bias apparatus is illustrated to avoid cluttering of the drawing however, a set of bias apparatus identical to that shown for cut out 170 is also used in cut-outs 172, 174, and 176 in the preferred embodiment. Biasing means for biasing an associated cam plate in a radially inward direction includes a spring retention nub 178 positioned on the radially inward axially and circumferentially extending surface of cut out 170 for receiving a lower portion of coil spring 184 thereabout. A spring retaining plate 180 which accepts the upper end of spring 184 is a U-shaped channel portion thereof is journaled at hole 182 to the lower end of threaded bolt 186. Bolt 186 is in turn threadingly received within a tapped bore 187 provided in block 188 which is fixedly attached to the adjacent radially extending surface of cam track 44. Coil spring 184 is thus adjustablely compressible by the adjustment of bolt 186 within bore 187 allowing the biasing pressure exerted against the cam plate by the spring 184 to be precisely adjusted. As best illustrated by FIGS. 3, 4, and 5, cam plate movement means 50, 52 may be provided by a power cylinder and wedge arrangement. The plate movement apparatus 50, 52 used for moving each plate is identical and thus only the apparatus for movement of plate 48 is illustrated in FIGS. 4 and 5. The plate movement means 52 comprises a power cylinder such as a pneumatic cylinder 190 driven by pneumatic lines 191, 193 and having an extendible and retractable piston arm 192 mounted for extension in a direction generally tangential to the turret wheel 30. The power cylinder 190 is fixedly attached as by pinning to clevis means 194 or other conventional attachment means which is in turn rigidly attached to support structure 36. A wedge means 195 having opposed wedge surfaces 196 197 is fixedly attached to the end of piston arm 192. The wedge surfaces 196, 197 contact circumferential surfaces of wedge rollers 198, 200. Wedge roller 198 is mounted on roller axial 199 which is fixedly attached to cam plate means 48. Wedge roller 200 is mounted on axle 201 which is fixedly attached to cam track 44. The wedge means 195 tapers inwardly in a direction away from cylinder 190. Thus extension of piston arm 192 causes wedge surfaces 196, 197 to urge rollers 198, 200 farther apart and retraction of the wedge 195 allows the bias means to move roller 198 in the direction of roller 200.

The relative position of the radially outwardly positioned peripheral surface of a cam plate means with respect to the radially outwardly peripheral surface of the cam track means is best illustrated in FIG. 4. In FIG. 4 cam plate means 48 having a cam engaging peripheral surface 214 is in a "raised" or "print" operating position, i.e. a radially outwardly displaced position, with respect to the cam engaging peripheral surface 210 of cam plate means 44. The outer edges 215, 217 of surface 214 are positioned in parallel alignment with the immediately opposite portion of idler cam track 44 when it is in the raised position to provide cam means 40 with a smooth transition from surface 210 to surface 214. When cam plate 48 is in this position, as illustrated in both FIGS. 3 and 4, the cam wheel means 40 engages a cam plate means 48 and is thus displaced to a position which is radially more remote than idler cam track surface 210. Since mandrel spindle means 15 is mounted in coaxial relationship with cam follower means 40 and since both are mounted on mandrel holder means 35, any radial displacement of cam follower means 40 produce a rotation of mandrel holder 35 which causes an equal amount of radial displacement of mandrel spindle means 15. Thus, the path followed by the mandrel spindle means 15, when cam follower means 40 follows surface 214, is positioned more radially outwardly than the path that the mandrel spindle follows when cam follower means 40 follows surface 210 of the idler cam means track 44. The cam track engaging surface 214 of cam plate means 48 is normally positioned in the location illustrated in FIGS. 3 and 4 and thus the cam follower normally engages surface 214 rather than idler cam surface 210 when the cam follower is in the printing region provided by indentation portion 45. In this configuration, as illustrated by FIG. 6, a can carried on the outer circumference of mandrel 15 makes engaging contact with the outer surface of blanket wheel 17 for a distance approximately equal to the circumference of the can.

Figure 8:
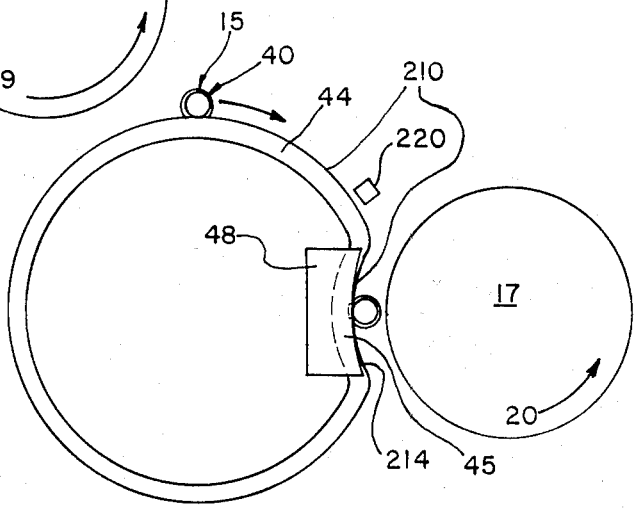
FIG. 8 is a schematic axial view of the mandrel wheel assembly illustrated in FIG. 6 in a skip-print configuration.

Cam plate means 48 may be moved radially inwardly by retraction of cylinder 192 to place the cam plate surface 214 at a position illustrated by the phantom line in FIG. 3 and shown schematically in FIG. 8. In this configuration, the cam follower means 40 engages surface 210 of the idler cam 44 rather than surface 214 of cam plate 48, thus causing the cam follower to follow a more radially inwardly positioned path. The path of the mandrel spindle 15 is thus also more radially inward than the previous path shown in FIG. 6. In this configuration, the surface of the can carried by the mandrel spindle 15, or the mandrel spindle surface itself if no can is positioned thereon, does not come into contact with the surface of blanket wheel 17 as illustrated by FIG. 8. Thus, in this embodiment, surface 214 of the cam plate means 48 engages cam follower wheel 105 in normal printing operations and idler cam track surface 210 engages cam follower means wheel 104 in skip-print operation. When the cam is out of the printing region, it engages idler cam track surface 210.

Of course, with minor modifications, the cam followers could be provided in a configuration made to follow a circumferential path at the radially inner circumference, as opposed to the radially outer circumference, of idler cam track 44. In this case, a cam plate would be used to move the cam follower into a radially more inward path than that provided by the idler cam track. In this situation, therefore, the cam plate surface would provide the skip-print function and the idler cam track surface would provide the normal printing function.

Sensing apparatus for sensing the presence or absence of proper seating of a can on a mandrel spindle is well known in the art. It would, in the preferred embodiment, be positioned as indicated by reference numeral 220 at a position approximately 8° from the leading edge 222 of the blanket wheel means 17 as illustrated in FIGS. 6–8. This sensing apparatus position is substantially closer to the blanket wheel than in previously used systems, where the distance between the sensing device and the blanket wheel was approximately 16° to accommodate the reaction time of mandrel holder carried trip apparatus. Since the sensing device used with the present invention is located closer to the blanket wheel, the can sensing function may be one of observation (i.e. the can will be fully seated on the mandrel spindle 15 at the time it passes the sensing device 220), as opposed to prediction, (i.e. wherein the can is moving towards a position of seating but is not yet entirely seated on the mandrel spindle). With the new location of the sensing device, machine performance is improved both in that unseated cans are never allowed to be printed, and also in that those properly seated cans which would have given off an erroneous prediction-based signal in the old arrangement are not skipped in the printing process.

Another embodiment of the cam track means of the mandrel assembly of the present invention is illustrated in FIGS. 9–17. In this particular embodiment, as illustrated schematically in FIGS. 9–12A, the cam track assembly means 300 comprises a fixed block cam track 310 having a fixed cam track cut-out portion 312 defined by opposite fixed cam terminal ends 311, 313. The fixed track cut-out portion is in an area of the cam track assembly which is proximate to blanket wheel 17. A moveable cam track means 314 is mounted within the cut-out portion 312 and is radially shiftable to positions associated with printing and with skip-printing of a cylindrical container 10 mounted on an associated mandrel spindle. The mandrel assembly 12 with the exclusion of the cam track assembly 300, is identical to the mandrel assembly of FIG. 2 described above in relation to the single surface cam track 44.

Figure 13:
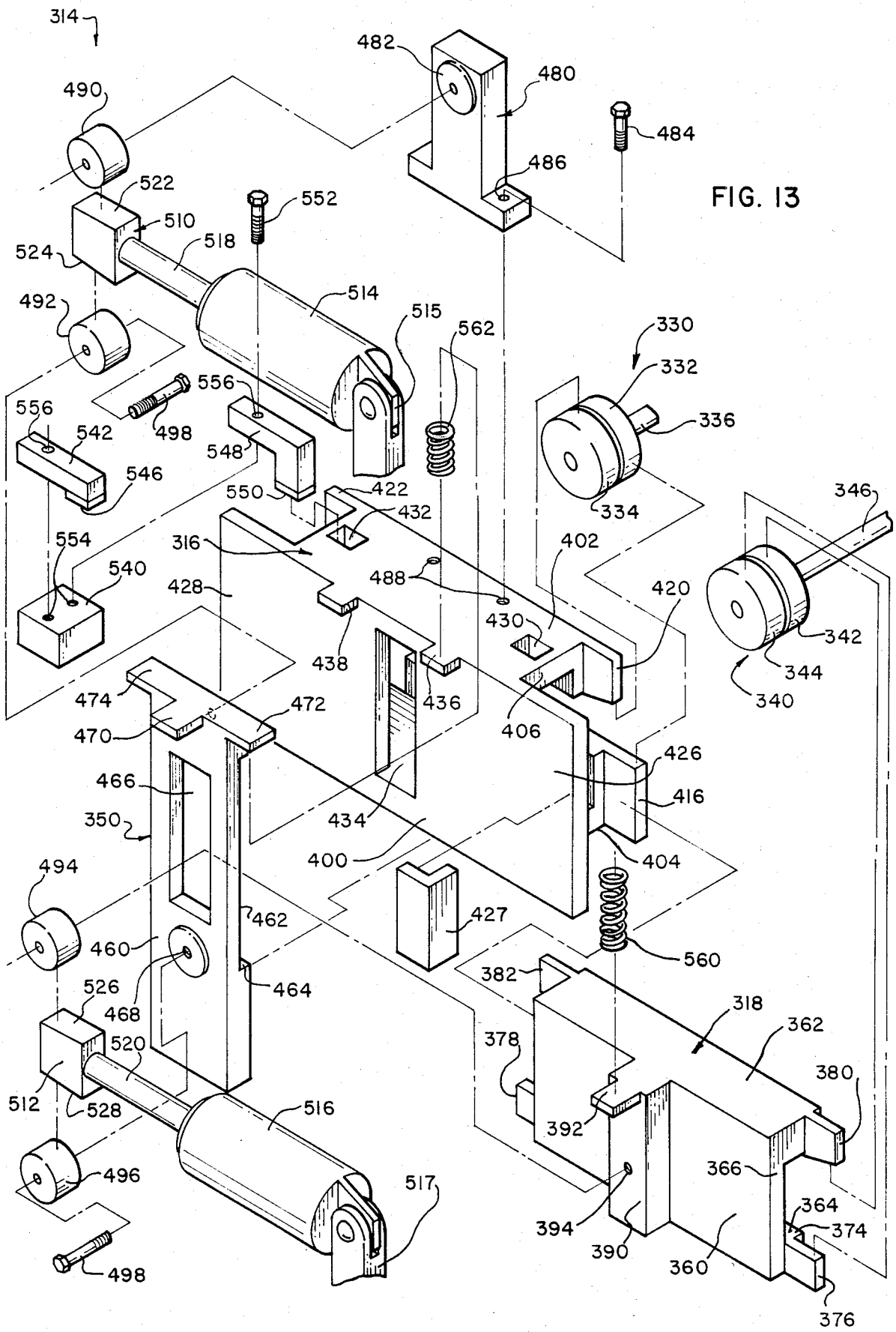
FIG. 13 is an exploded perspective view of a movable track portion of a block-cam cam track assembly.
Figure 14:
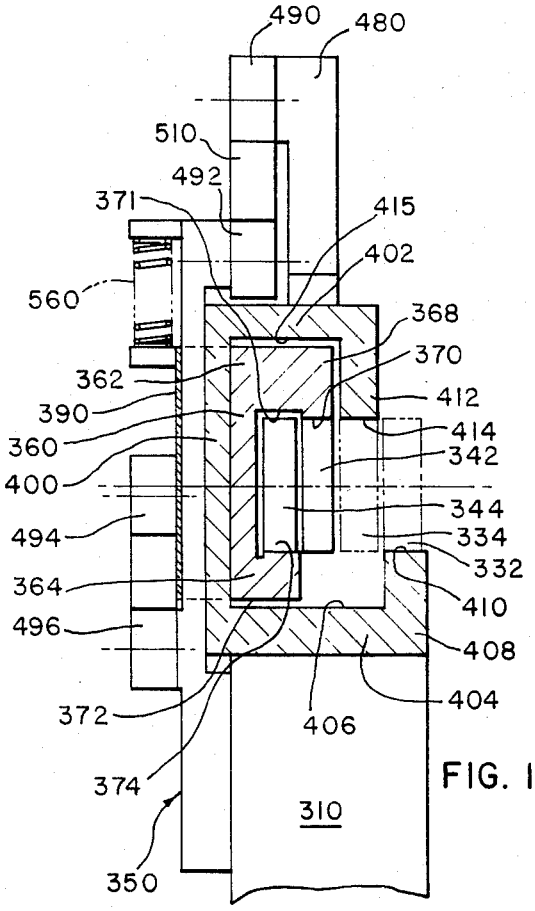
FIG. 14 is a cross-sectional view of the movable track portion of the block-cam cam track assembly.

The movable cam track means 314, as best illustrated in FIGS. 13 and 14, comprises an outer C-shaped plate 316 and an inner C-shaped plate 318. The outer C-shaped plate 316 is moved radially between a printing and skip-printing position and coacts with cam wheel means 330 provided on every other mandrel holder 35 referred to herein as "even" mandrel holders. The "even" cam wheel means 330 associated with even mandrel holders each comprise a first cam wheel 332 and a second cam wheel 334 coaxially aligned with the first cam wheel, having a common central wheel shaft 336 with a central axis CC coaxially aligned with the central axis BB of the associated mandrel spindle 15, FIGS. 9A and 11A. The mandrel holders 35 positioned between the even mandrel holders are referred to herein as "odd" mandrel holders. Each of the odd mandrel holders 35 are provided with "odd" cam wheel means 340 comprising third cam wheel 342 and fourth cam wheel 344 coaxially mounted on odd cam wheel shaft 346. The odd and even cam wheel means 330, 340 are, of course, circumferentially spaced apart along the cam track assembly means 300 and are shown as being coaxially aligned in FIGS. 14 and 16, only for the purpose of showing where each cam wheel makes contact with the cam track surface. Referring again to FIG. 13, it may be seen that a fixed support structure 350 is provided for guidingly holding the two C-shaped plates 316, 318 in a manner which permits independent radial movement of each of the C-shaped plates.

As best illustrated by FIGS. 13 and 14, inner C-shaped plate 318 comprises a radially extending body portion 360 integrally connected with an outer axially extending portion 362 and an inner axially extending portion 364 creating a generally C-shaped enclosure. The plate terminates in a first planar end surface 366 and a second planar end surface 367, FIG. 17. As best shown by FIG. 14, the outer axially extending portion 362 comprises a radially inwardly projecting portion 368 at the free end thereof which terminates in a substantially planar third cam wheel contacting surface 370 having an axial dimension substantially equal to the axial dimension of the third cam wheel 342. A radially outwardly projecting portion 372 is provided at the free end of portion 364 and terminates at a generally planar fourth cam wheel contacting surface 374 of substantially the same axial dimension as the fourth cam wheel 344. Outer axially extending portion 362 also comprises a surface 371 slightly radially outwardly recessed from third cam wheel contacting surface 370. Surface 371 is recessed to prevent contact with fourth cam wheel 344. Thus, the two cam surfaces 370, 374 provide a conventional box-cam arrangement for contacting diametrically opposite portions of two separate cam wheels to guide the wheels along a predetermined path defined by those surfaces 370, 374. As best illustrated by FIG. 13, each of the inner C-shaped cam wheel contacting surfaces 370, 374 is continuous with surface portions of two circumferentially extending tabs: tabs 376, 378 with respect to surface 374 and tabs 380, 382 with respect to surface 370. Each of the tabs 376–382 comprise a width (axially measured dimension) substantially the width of an associated radially projecting portion 368, 372. Each of the tabs is adapted to matingly mesh with opposite tabs provided at end portions 311, 313 of the fixed track in a manner to provide a smooth transition between the third and fourth cam wheel contacting surfaces on inner C-shaped plate 318 and associated third and fourth cam wheel contacting surfaces on the fixed track 310 as is discussed in greater detail hereinafter.

As best illustrated by FIG. 13, an axially projecting radially elongate key portion 390 is symmetrically positioned on the outer surface of radially extending body portion 360 of the inner C-shaped plate 318 and comprises a further axially extending spring engaging tab portion 392 at an upper portion thereof and an outer shaft mounting bore 394 at a central location thereon.

Figure 17:
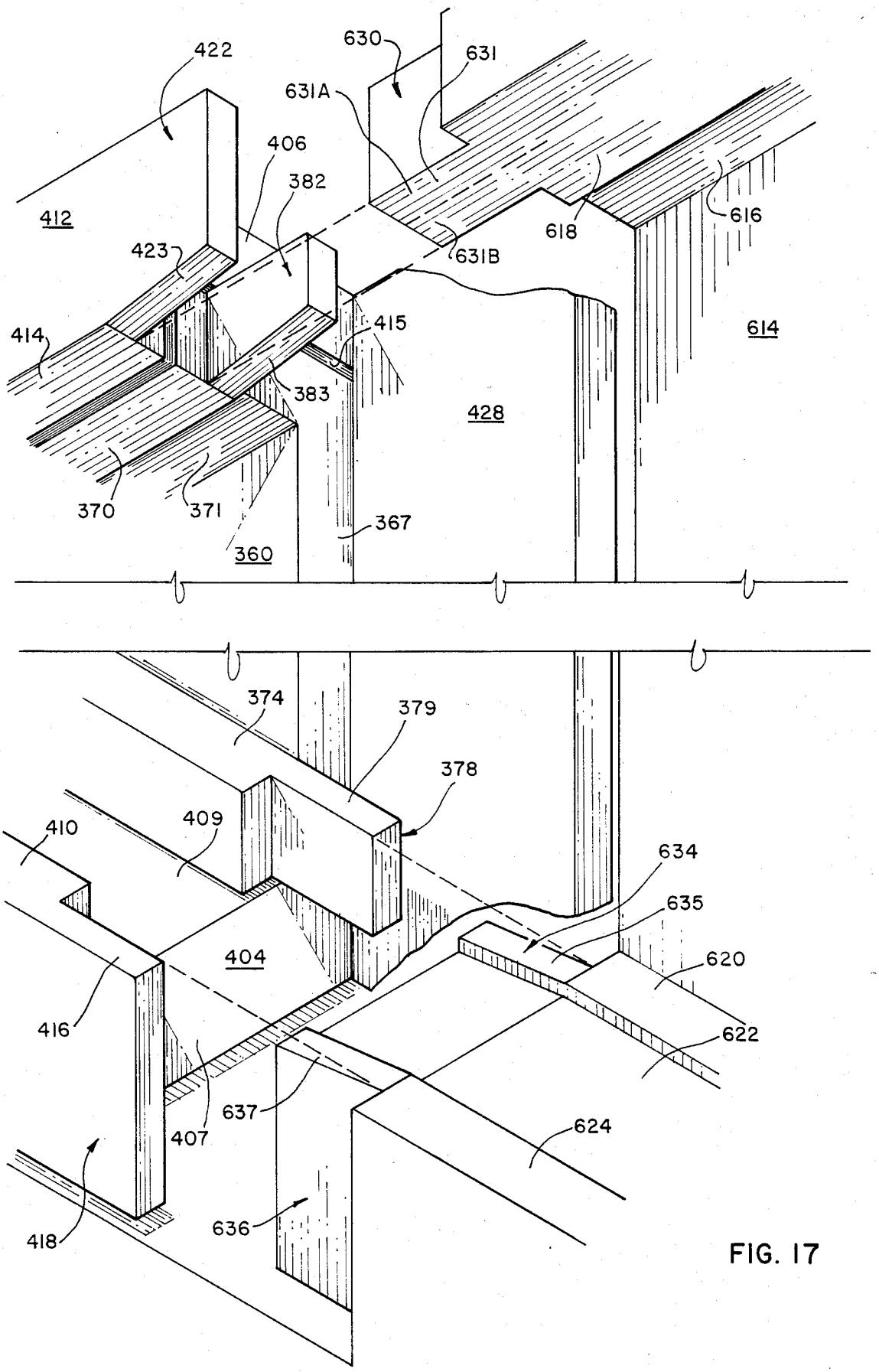
FIG. 17 is an exploded detailed view of intermeshing tab portions of a movable track portion and a fixed track portion of a block-cam cam track assembly.

Outer C-shaped plate 316, as best illustrated by FIGS. 13 and 14, comprises a radially extending body portion 400 integrally formed with an outer axially extending portion 402 and an inner axially extending portion 404. The main body portion of the outer C-shaped plate terminates in a first planar end surface 406 and a second planar end surface 407, FIG. 17. As shown by FIG. 14, a radially outwardly projecting portion 408 of inner axially extending portion 404 terminates in a substantially planar first cam wheel engaging surface 410 of substantially the same axial dimension as that of the first cam wheel 332. A radially, inwardly projecting portion 412 of outer axially extending portion 402 terminates in a generally planar second cam wheel engaging surface 414. An inner axially extending surface 415 of portion 402 and an inner axially extending surface 409 of portion 404 are spaced a sufficient distance apart to allow for a relatively small axial displacement of inner C-shaped plate 318 which is positioned in the C-shaped enclosure defined by the outer C-shaped plate 316. Two tab portions 416, 418, FIGS. 13 and 17, are associated with surface 410 and two tabs 420, 422 are associated with surface 414. These tabs 416, 418, 420, 422 mesh with adjacent tab portions on the fixed track to provide a smooth transition for associated cam wheels when the outer C-shaped plate is in either a print or skip-print position, as described in further detail hereinafter. Outer C-shaped plate 316 also comprises a first wing 426 and a second wing 428 which are chordwise extensions of radially extending body portion 400. The first and second wings 426, 428 are received within two L-shaped brackets 427 fixedly mounted on the end portions 311, 313 of the fixed rack 310. One of the L-shaped brackets 427 is illustrated in FIG. 13, however the brackets are omitted from the other Figures to avoid clutter. A first stop cut-out 430 and a second stop cut-out 432 are provided for allowing access of a stop means to inner C-shaped plate 318, as discussed in further detail hereinafter. A radially extending key cut-out 434 is provided in radially extending body portion 400 and is adapted to permit relative radial movement of key portion 390 therewithin while preventing circumferential displacement of the key 390.

As further illustrated by FIG. 13, fixed support 350 comprises a relatively narrow radially extending plate 460 having a C-shaped recess 462 therein having a radial dimension slightly greater than that of outer C-shaped plate 316 permitting relative radial displacement of the outer C-shaped plate therewithin. The C-shaped recess 462 terminates in a lower stop surface 464 which limits the radial downward movement of the outer C-shaped plate 316. The radially extending plate 460 also comprises a key receiving cut-out portion 466 adapted to accept key 390 in radially displaceable, axially non-displaceable relationship therewithin. A wheel axel mounting bore 468 is provided at a mid portion of plate 460 below key receiving cut-out 466, and a spring tab 470 for bearing on a compression spring 560 is provided at a position on plate 460 above tab 392 on the inner C-shaped plate. Circumferentially projecting tabs 472, 474 are also provided in coplanar relationship with axially projecting tab 470 and in radial alignment with tabs 436, 438 for bearing on springs 562. A wheel mounting block 480 having a wheel mounting bore 482 therein is fixedly attached to outer C-shaped plate 316 as by bolts 484 received within bolt holes 486 of the block and bolt holes 488 of outer C-shaped plate portion 406. A first wheel 490 of a wheel pair 490, 492 is rotatably mounted as by a mounting bolt in bore 482. A second wheel 492 is mounted as by a bolt 498 at an upper inwardly positioned surface of fixed support 350 as best illustrated by FIGS. 13 and 14. A second wheel pair 494, 496 are similarly mounted in fixed support outer bore 468 and key bore 394. A first wedge 510 and a second wedge 512 are provided between the first wheel pair and second wheel pair respectively. The first wedge 510 is associated with a first cylinder 514 attached to fixed support structure such as the fixed cam track as by a clevis 515 and the second wedge 512 is associated with a second cylinder 516 fixedly attached to support structure as by a second clevis 517. The first wedge 510 is mounted on a first piston rod portion 518 of the first cylinder 514 and the second wedge 512 is fixedly mounted on a second piston rod 520 of the second cylinder 516. First wedge surfaces 522, 524 which taper inwardly in a direction distal associated piston rod 518 and second wedge surfaces 526 and 528 which taper radially inwardly in a direction distal associated piston rod 520, cause the associated wheel pairs 490, 492 or 494, 496 to be separated as an associated piston rod 518, 520 is extended. Tabs 472, 474 on the fixed structure 350 and tabs 436 and 438 on the outer C-shaped plate compressibly receive compression springs 562, FIG. 15, therebetween for the purpose of biasing the outer C-shaped plate radially inwardly. Tabs 470 and 392 receive compression spring 560 therebetween which biases inner C-shaped plate 318 inwardly. The outward movement of piston rods 518 and 520 thus act to move C-shaped plates 316 and 318 respectively in a direction opposite to the biasing force exerted thereon by spring 562 and 560 respectively.

Figure 15:
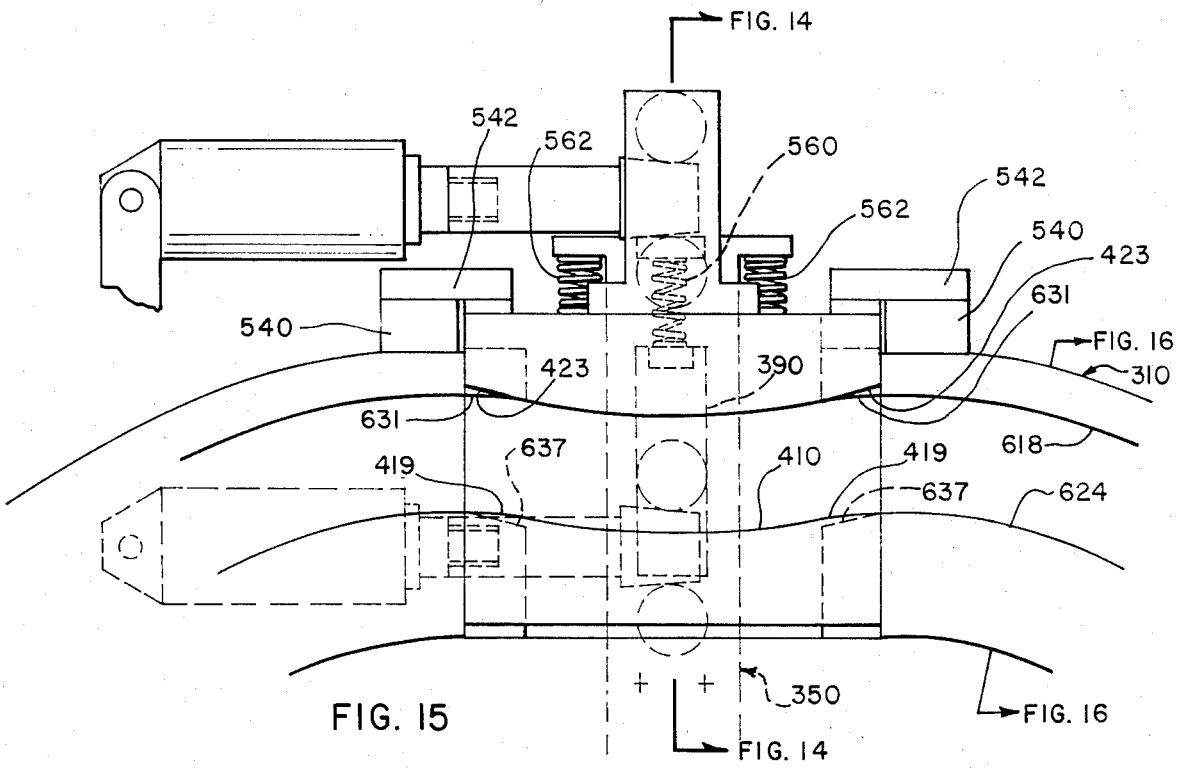
FIG. 15 is a axial view of a portion of a fixed track and a movable track of a block-cam cam track assembly.

Two stop mounting blocks 540, FIGS. 13 and 15, are provided, each being attached to an end portion 311, 313 of fixed track 310. A first stop bar 542 having an outer C-shaped plate contact surface 546 and a second stop bar 548 having an inner C-shaped plate contact surface 550 thereon are fixedly attached as by bolts 552 through bolt holes 554 and 556 to each block 540. The stop mounting block 540 and associated stop bars 542, 548 are not shown in FIG. 14 to avoid clutter.

Figure 16:
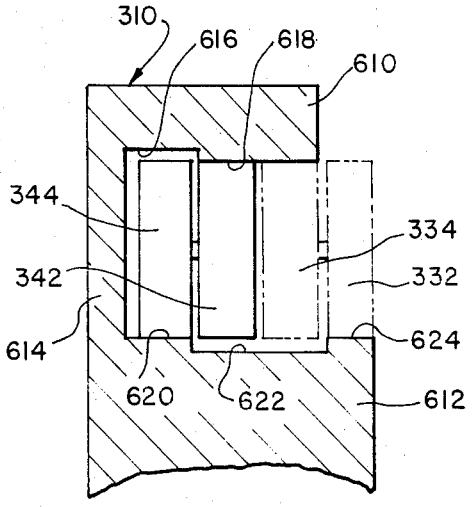
FIG. 16 is a cross-sectional view of a fixed track portion of the block-cam cam track assembly.

Fixed track 310, as shown in cross-section in FIG. 16, comprises an outer axially extending portion 610, an inner axially extending portion 612 and a radially extending body portion 614 connecting the two axially extending portions 610, 612 to define a generally C-shaped enclosure. Portion 610 comprises a first surface area 616 which is recessed from a second surface area 618. Surface 616 provides clearance above fourth cam wheel 344 and surface 618 provides a contact surface for second and third cam wheels 334, 342. Portion 612 comprises a first surface area 620, a second surface area 622 and a third surface area 624. The second surface area 622 is recessed from the first and third surface areas. The first surface area 620 engages fourth cam wheel 344, second surface area 322 provides clearance below second and third cam wheels 334 and 342 and third surface area 624 provides a contact surface for guiding first cam wheel 332. The cross-sectional arrangement illustrated in FIG. 16 exists throughout the circumferential length of the fixed cam track 310. At each of the terminal ends 311, 313 of the fixed cam track there are provided an upper tab 630 having an upper tab surface 631, a lower tab 634 having a lower tab surface 635 and a lower tab 636 having a lower tab surface 637 as illustrated in FIGS. 15 and 17. Each tab has a axially measured dimension of approximately one half the axial dimension of an associated cam wheel and is adapted to mesh with an associated tab portion provided on a moveable plate 316, 318.

The general method of assembly of the two C-shaped plates 316, 318 and associated structure is illustrated by the phantom lines in FIG. 13. The key receiving portions 466, 434 are positioned in alignment and receive key portion 390 of inner C-shaped plate 318 therethrough, thereby holding the two C-shaped plates 316, 318 in circumferentially fixed relationship relative fixed member 350. L-shaped brackets 427 mounted on either end of the fixed track 311, 313 slidingly engage wings 426, 428 therewithin preventing either of the C-shaped plates from moving axially relative fixed member 350. The L-shaped brackets may be attached to the fixed member as by bolts not shown, weldement or other conventional attachment well known in the art. Both key receiving cut-out portions 466 and 434 are radially longer than key portion 390, thus allowing both C-shaped plates to move radially relative fixed member 350. A cross-sectional configuration of this mounting arrangement is illustrated in FIG. 14.

The meshing tab structure of the fixed cam track 310 and movable C-shaped plates 316, 318 is illustrated in exploded detail in FIG. 17. Only one interface portion is illustrated since the interface structure of the C-shaped plates with the fixed track is the same at both ends 311, 313 of the fixed track. In the drawing in FIG. 17 both of the movable plates 316, 318 (shown generally on the left hand portion of the drawing) are in an "up" position, i.e. a radially outwardly displaced position associated with printing of a cylindrical container. It may be seen that in this "up" position, the outer C-shaped member first cam wheel engaging surface 410 and the generally planar extension of that surface 416 on tab 418 is positioned substantially parallel to surface 624 and is raised relative a ramp surface portion 637 of fixed track tab portion 636. When the outer C-shaped plate is in a lowered position, surface 416 is at the same elevation as the most radially inwardly positioned portion of ramp surface 637 and when inner C-shaped plate is in a lowered position, surface 379 is at the same elevation as the lower portion of ramp surface 634. Thus, when surface 410 is in an up position, a cam wheel passing from it into the transition area provided by the two tabs 418, 636 will engage surface 416 and thereafter surface 624. When the outer C-shaped plate is in a lowered position, a first cam wheel traveling over surface 410 will engage surface 637 rather than surface 416 and will be carried upwardly thereby onto surface 624.

Figure 9:
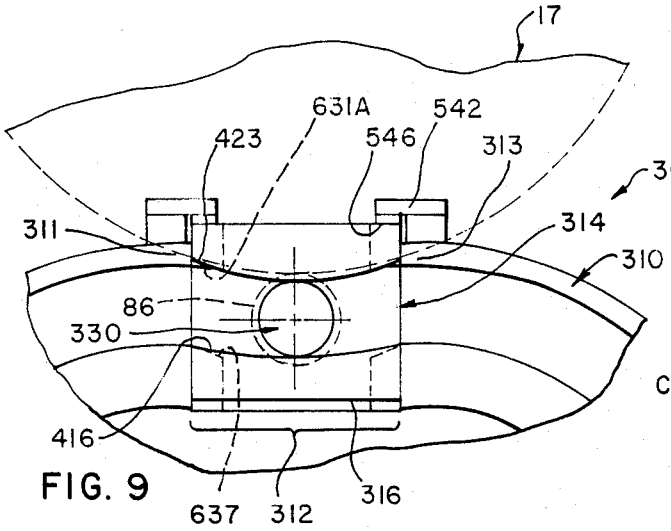
FIG. 9 is a schematic axial view of a block-cam cam track assembly with an outer C-shaped plate in a print position.
Figure 9A:
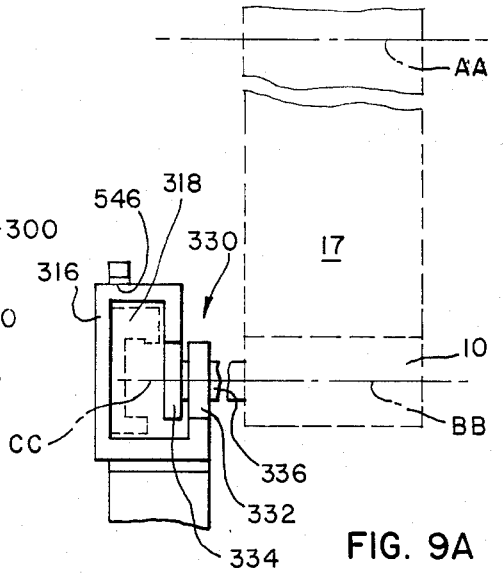
FIG. 9A is a cross-sectional view of the cam track assembly of FIG. 9.
Figure 11:
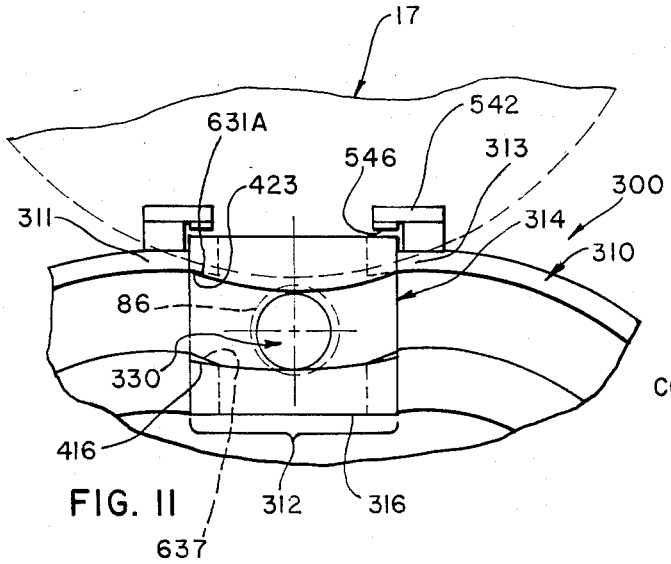
FIG. 11 is a schematic axial view of a block-cam cam track assembly with an outer C-shaped plate in a skip-print position.
Figure 11A:
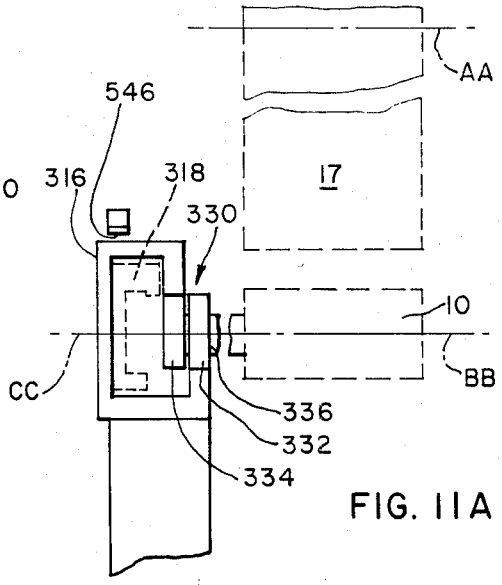
FIG. 11A is a cross-sectional view of the cam track assembly of FIG. 11.

The surfaces associated with the second cam wheel are outer C-shaped plate surface 414 and associated radially outwardly sloped ramp surface 423 of tab portion 422 and the half of tab 630, surface portion 631 positioned adjacent tab 422. This surface is indicated as 631A which is divided from surface 631B by a dotted line, only for purposes of clarity. Of course, there is no physical division of the tab 630 in the operating structure. In a raised position of the outer C-shaped plate, as illustrated in FIG. 17 and in FIG. 9, surface 631A which is coplanar with surface 618 is also essentially coplanar with surface 414 and thus a cam wheel passing through the transition zone where the tabs 622, 630 intermesh will be engaged by surface 631A. When the outer C-shaped plate is in the up position, illustrated in FIGS. 9 and 9A, even cam wheels 332 and 334 are guided by the plate along a path whereby a container 10 carried by the associated even mandrel spindle makes printing contact with the surface of blanket wheel 17. Thus, the up position of outer C-shaped plate 316 is associated with even container printing. The position which outer C-shaped plate 316 occupies, when it is in the up position, is determined by stop surface 546 which engages the radially outwardly positioned surface of plate 316. Since surface 546 is fixed relative the fixed track, plate 316 is moved to the same up position each time. The member 542 providing surface 546 may be readily replaced when worn to insure a proper printing relationship between the blanket wheel 17 and cams 10 on even mandrels. The lowered position of the outer C-shaped plate may be predetermined by a lower stop means such as ledge surface 464 on fixed structure 350. Having an exact lowered position is of course not critical since the lowered position is associated with skip-printing and the exact amount of space between the blanket wheel 17 and cam 10 is not critical. In a preferred embodiment, the space between cam and blanket wheel 17 in the skip print mode is approximately 8.2 inches. The relative position of the outer C-shaped plate during printing is shown in FIGS. 9 and 9A. The relative position of the outer C-shaped plate during skip-print operation is shown in FIGS. 11 and 11A.

A fourth cam wheel engaging surface portion 379 of inner C-shaped member lower tab portion 378 is coplanarly aligned with inner C-shaped member surface 374 and fixed track fourth cam wheel engaging surface 620. In the "up" position, each of the movable plate surfaces 416 and 379 is positioned above an associated radially inwardly sloping ramp surface 637, 634 of an adjacent fixed plate tab portion 636, 635.

Figure 10:
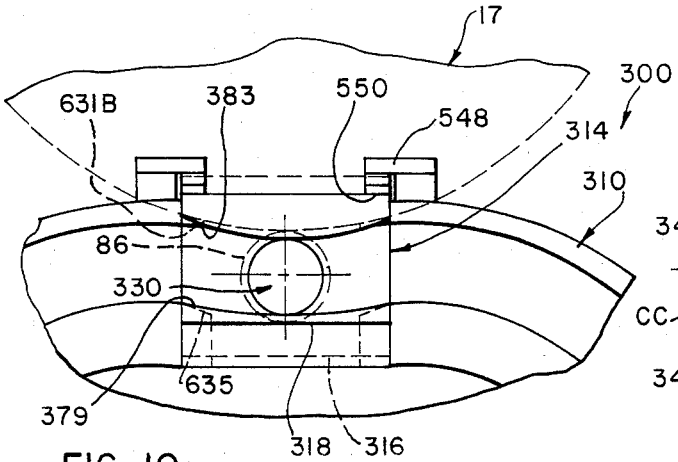
FIG. 10 is a schematic axial view of a block-cam cam track assembly with an inner C-shaped plate in a print position.
Figure 10A:
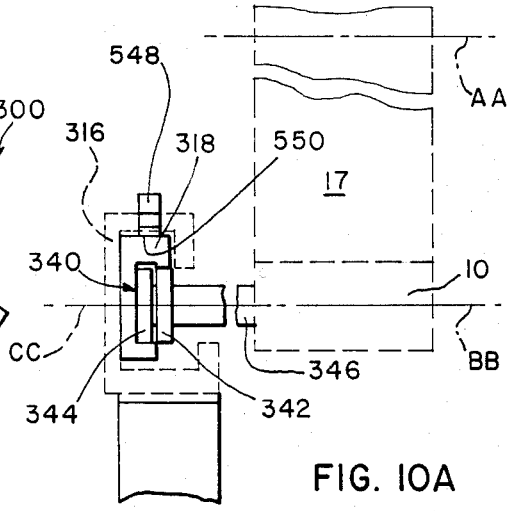
FIG. 10A is a cross-sectional view of the cam track assembly of FIG. 10.
Figure 12:
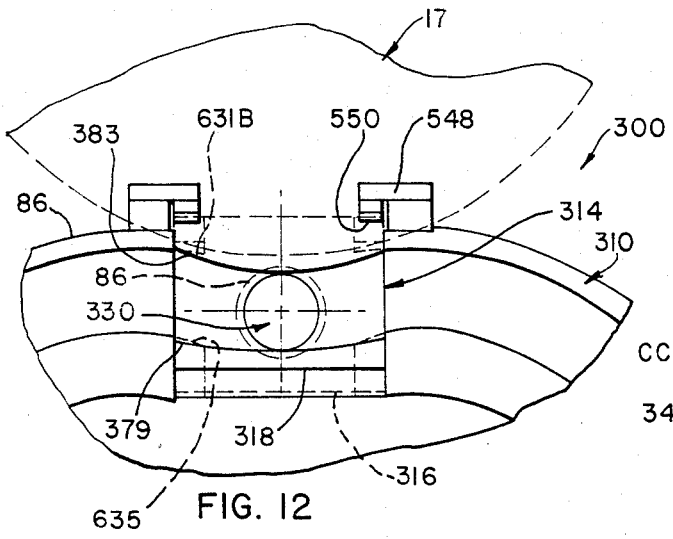
FIG. 12 is a schematic axial view of a block-cam cam track assembly with an outer C-shaped plate in a skip-print position.
Figure 12A:
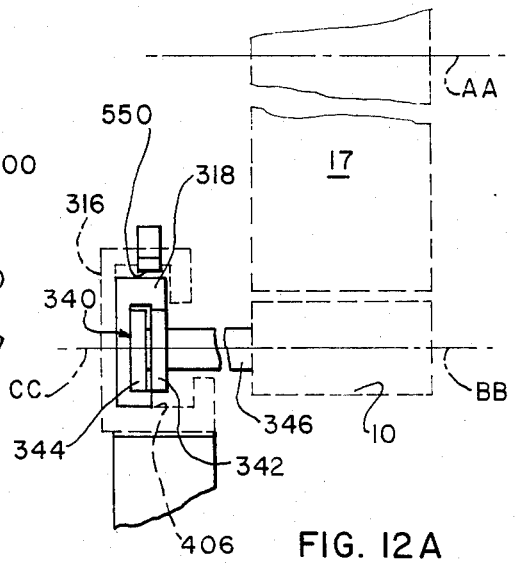
FIG. 12A is a cross-sectional view of the cam track assembly of FIG. 11.

A third cam wheel engaging surface is provided by inner C-shaped plate surface 370, tab 382, radially outwardly sloped ramp surface 383, tab 630, surface portion 631B and fixed plate surface 618. When the inner C-shaped plate is in an "up" position associated with can printing, surface 631B is positioned in essentially coplanar relationship with surface 370 and thus a cam wheel passing through the transition area will engage surface 370, then surface 631B and then surface 618. However, when the inner C-shaped plate is in a lowered position associated with skip-printing, the distal end of tab surface 383 is approximately at the same elevation as surface 618 and a cam follower passing through the transition region passes first along surface 370 then engages surface 383 and travels upwardly thereon until passing into engaging contact with surface 618. The relative position of inner C-shaped plate 318 in an up position is illustrated in FIGS. 10 and 10A. As illustrated by FIG. 10A, a radially outwardly positioned surface of the inner C-shaped plate 318 engages a stop surface 550 provided on stop member 548 when the inner C-shaped plate is in the up or print position. FIGS. 12 and 12A illustrate the position of the inner C-shaped plate 318 in the down or skip-print position. It may be seen from FIG. 12A that in this position, inner C-shaped plate 318 may rest on an inner axially extending surface portion 406 of the outer C-shaped plate.

Figure 18:
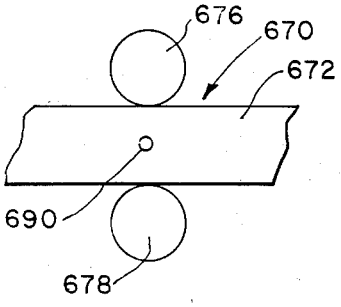
FIG. 18 is a schematic axial view of a movable plate portion of a plate-cam cam track assembly.
Figure 19:
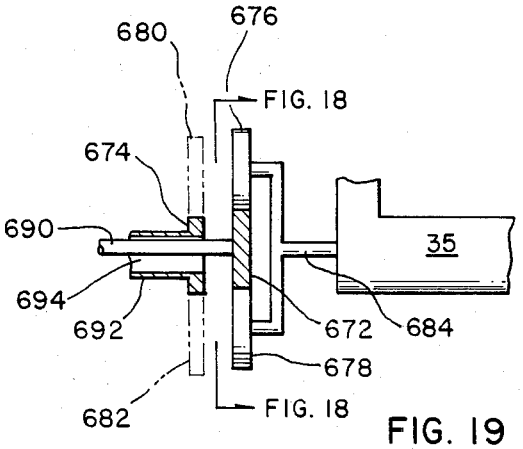
FIG. 19 is a cross-sectional view of the cam track assembly of FIG. 18.

Although the tab arrangement shown in FIG. 17 and FIGS. 9, 9A through 12, 12A are presently preferred, other arrangements of the tabs and tab surfaces may also be employed and are within the scope of the invention. Similarly, the cam surfaces provided on the fixed rack and movable plate in the box cam arrangement described with reference to FIGS. 9 through 17 may be provided in a plate cam track assembly 670, FIGS. 18, 19, having a movable portion comprising a first cam track plate 672 and a second cam track plate 674 which is independently movable with respect thereto. Coplanar roller pairs 676, 678 may be associated with the first cam track 672 and a second coplanar roller pairs 680, 682 may be associated with the second cam track plate 674. Each coplanar roller pair may be supported on a Y-shaped yoke which is pivotally mounted on a mandrel holder 35 of otherwise identical construction to that illustrated in FIG. 2. The first plate cam may be moved radially with respect to the mandrel wheel axis by a first plate cam support shaft 690 mounted within a sleeve 692 which supports the second cam plate 674. A hollow bore 694 within the sleeve 692 is of a sufficient dimension to allow relative radial displacement of shaft 690 or sleeve 692 to provide a print and skip-print function for each movable cam track plate 672, 674. The interface of the movable cam track plate 672, 674 with an associated fixed plate cam track may be accomplished by adjacent tab portions, some of which having ramp surfaces in the same manner as discussed above with respect to the block cam arrangement. Similar radial movement means and biasing means to those discussed above may also be provided and operably attached to the shaft 690 and sleeve 692 to provide the necessary radial displacement thereof to effect the print and skip-print functions of the associated cam track plates 672, 674.

The embodiment of FIGS. 9–17 is the best mode presently contemplated for the invention.

It is contemplated that the inventive concepts herein described may be variously otherwise embodied and it is intended that the appended claims be construed to include alternative embodiments of the invention except insofar as limited by the prior art.

What is claimed is:

1. A mandrel assembly for use in a continuous printing machine for cylindrical containers comprising:

a. mandrel wheel means for supporting cylindrical container receiving apparatus thereon, said mandrel wheel means having a central axis of rotation positioned in parallel alignment with a central axis of rotation of an associated blanket wheel device carrying a printing medium on a circumferential portion thereof for printing on said cylindrical containers carried by said mandrel wheel means;

b. at least one mandrel holder means for supporting a mandrel spindle means thereon, pivotally mounted on a circumferential portion of said mandrel wheel means for pivotal movement about a mandrel holder pivot axis positioned substantially parallel to said mandrel wheel central axis of rotation;

c. elongate mandrel spindle means for supporting a cylindrical container on a peripheral surface thereof, rotatably mounted on said mandrel holder means for rotation about a central axis of rotation positioned in substantially parallel, non-coaxial relationship with said mandrel holder pivot axis whereby said mandrel spindle means is radially displaceable relative said central axis of rotation of said mandrel wheel means by pivotal movement of said mandrel holder means about said mandrel holder pivot axis;

d. cam follower means for following a cam track means, rotatably mounted on said mandrel holder means for rotation about a central axis of rotation positioned in substantially parallel, non-coaxial relationship with said mandrel holder pivot axis whereby said mandrel holder means is pivotally displaced about said mandrel holder means pivot axis by radial displacement of said cam follower means relative said central axis of rotation of said mandrel wheel means;

e. cam track means operably associated with said cam follower means for guiding said cam follower means and for causing preselected relative radial displacement thereof with respect to said central axis of rotation of said mandrel wheel means for causing preselected radial displacement of said mandrel spindle means relative said blanket wheel device whereby when said mandrel wheel means is in a rotated position associated with cylindrical container printing, and when said mandrel spindle is in a normal operating state wherein said mandrel spindle has a cylindrical container properly seated thereon, said mandrel spindle is positioned to urge said cylinder container into printing contact with said blanket wheel device; and whereby when said mandrel wheel means is in said rotated position associated with cylindrical container printing and when said mandrel spindle is in a skip-print operating wherein said mandrel spindle does not have a cylindrical container properly seated thereon, said mandrel spindle is positioned in radially spaced apart, non-engaging relationship with said blanket wheel device; and f. control means for sensing the position of a can on an associated mandrel wheel and actuating said cam track means in response to the can position;

wherein said cam track means comprises a cam track printing portion thereon associated with movement of said mandrel spindle means into a proximate relationship with the blanket wheel device and wherein said cam track printing portion comprises:

printing path means for engaging said cam follower means in said normal operating state and for guiding said cam follower means to cause a printing engagement between the blanket wheel device and a container carried by said mandrel spindle, and skip-printing path means for engaging said cam wheel means in said skip-print operating state and for guiding said cam follower means to cause said mandrel spindle to be deflected away from printing engagement with the blanket wheel device;

wherein said printing path means and said skip-printing path means comprise operating surfaces which are radially displaceable with respect to one another;

wherein said cam track means comprises a substantially continuous, closed loop, cam follower engaging fixed track and a relatively short length cam follower engaging moveable track positioned in axially offset relationship with said fixed track, said moveable track being positioned within said cam track printing portion;

wherein said printing path means comprises one of said fixed track and said moveable track and wherein said skip-printing path means comprises the other of said fixed track and said moveable track;

moveable track movement means for radially moving said second track relative said first track between a skip-print operating position and a normal operating position;

wherein said moveable track movement means comprises:

first roller means having an axis fixedly attached to said moveable track means;

second roller means having an axis positioned in parallel relationship with said first roller means axis, said second roller means axis being fixed relative fixed track;

wedge means positionable between said first and second roller means in contacting engagement therewith;

and wedge movement means for moving said wedge means between said first and second roller means for causing displacement of said first roller means relative said second roller means.

2. A mandrel assembly for use in a continuous printing machine for cylindrical containers comprising:

a. mandrel wheel means for supporting cylindrical container receiving apparatus thereon, said mandrel wheel means having a central axis of rotation positioned in parallel alignment with a central axis of rotation of an associated blanket wheel device carrying a printing medium on a circumferential portion thereof for printing on said cylindrical containers carried by said mandrel wheel means;

b. at least one mandrel holder means for supporting a mandrel spindle means thereon, pivotally mounted on a circumferential portion of said mandrel wheel means for pivotal movement about a mandrel holder pivot axis positioned substantially parallel to said mandrel wheel central axis of rotation;

c. elongate mandrel spindle means for supporting a cylindrical container on a peripheral surface thereof, rotatably mounted on said mandrel holder means for rotation about a central axis of rotation positioned in substantially parallel, non-coaxial relationship with said mandrel holder pivot axis whereby said mandrel spindle means is radially displaceable relative said central axis of rotation of said mandrel wheel means by pivotal movement of said mandrel holder means about said mandrel holder pivot axis;

d. cam follower means for following a cam track means, rotatably mounted on said mandrel holder means for rotation about a central axis of rotation positioned in substantially parallel, non-coaxial relationship with said mandrel holder pivot axis whereby said mandrel holder means is pivotally displaced about said mandrel holder means pivot axis by radial displacement of said cam follower means relative said central axis of rotation of said mandrel wheel means;

e. cam track means operably associated with said cam follower means for guiding said cam follower means and for causing preselected relative radial displacement thereof with respect to said central axis of rotation of said mandrel wheel means for causing preselected radial displacement of said mandrel spindle means relative said blanket wheel device whereby when said mandrel wheel means is in a rotated position associated with cylindrical container printing, and when said mandrel spindle is in a normal operating state wherein said mandrel spindle has a cylindrical container properly seated thereon, said mandrel spindle is positioned to urge said cylinder container into printing contact with said blanket wheel device; and whereby when said mandrel wheel means is in said rotated position associated with cylindrical container printing and when said mandrel spindle is in a skip-print operating state wherein said mandrel spindle does not have a cylindrical container properly seated thereon, said mandrel spindle is positioned in radially spaced apart, non-engaging relationship with said blanket wheel device; and f. control means for sensing the position of a can on an associated mandrel wheel and actuating said cam track means in response to the can position;

wherein said cam track means comprises a cam track printing portion thereon associated with movement of said mandrel spindle means into a proximate relationship with the blanket wheel device and wherein said cam track printing portion comprises:

printing path means for engaging said cam follower means in said normal operating state and for guiding said cam follower means to cause a printing engagement between the blanket wheel device and a container carried by said mandrel spindle, and skip-printing path means for engaging said cam wheel means in said skip-print operating state and for guiding said cam follower means to cause said mandrel spindle to be deflected away from printing engagement with the blanket wheel device;

wherein said printing path means and said skip-printing path means comprise operating surfaces which are radially displaceable with respect to one another;

wherein said cam track means comprises a substantially continuous, closed loop, cam follower engaging fixed track and a relatively short length cam follower engaging moveable track positioned in axially offset relationship with said fixed track, said moveable track being positioned within said cam track printing portion;

wherein said printing path means comprises said moveable track and wherein said skip-printing path means comprises said fixed track;

wherein said moveable track comprises a first radially extending moveable plate having a radially remote, axially and circumferentially extending, cam follower engaging surface and having a first radially extending key guide cut-out portion centrally positioned therein and having two stop means accepting cut-out portions and two adjustable biasing means cut-out portions symmetrically positioned therein in symmetrical relationship about said key guide cut-out portion; and wherein said fixed cam track comprises a radially extending fixed plate having a radially outer, axially and circumferentially extending cam follower engaging surface, and having an axially projecting elongate key portion fixedly attached to a radially extending surface thereof and constructed and arranged to be guidingly received within said key guide cut-out portion;

and further comprising L-shaped bracket means fixedly mounted on a radially extending surface of said fixed plate for restraining said moveable plate from axial movement relative said fixed plate.

3. The invention of claim 2 wherein said moveable track comprises a second radially extending moveable plate of substantially identical construction to said first moveable plate and operably mounted on a radially extending surface of said fixed plate opposite the mounting surface of said first plate in mirror image relationship with said first moveable plate, said moveable plates being constructed and arranged to be operably associated with cam followers on alternating mandrel holder means of said mandrel wheel means.

4. A mandrel assembly for use in a continuous printing machine for cylindrical containers comprising:

a. mandrel wheel means for supporting cylindrical container receiving apparatus thereon, said mandrel wheel means having a central axis of rotation positioned in parallel alignment with a central axis of rotation of an associated blanket wheel device carrying a printing medium on a circumferential portion thereof for printing on said cylindrical containers carried by said mandrel wheel means;

b. at least one mandrel holder means for supporting a mandrel spindle means thereon, pivotally mounted on a circumferential portion of said mandrel wheel means for pivotal movement about a mandrel holder pivot axis positioned substantially parallel to said mandrel wheel central axis of rotation;

c. elongate mandrel spindle means for supporting a cylindrical container on a peripheral surface thereof, rotatably mounted on said mandrel holder means for rotation about a central axis of rotation positioned in substantially parallel, non-coaxial relationship with said mandrel holder pivot axis whereby said mandrel spindle means is radially displaceable relative said central axis of rotation of said mandrel wheel means by pivotal movement of said mandrel holder means about said mandrel holder pivot axis;

d. cam follower means for following a cam track means, rotatably mounted on said mandrel holder means for rotation about a central axis of rotation positioned in substantially parallel, non-coaxial relationship with said mandrel holder pivot axis whereby said mandrel holder means is pivotally displaced about said mandrel holder means pivot axis by radial displacement of said cam follower means relative said central axis of rotation of said mandrel wheel means;

e. cam track means operably associated with said cam follower means for guiding said cam follower means and for causing preselected relative radial displacement thereof with respect to said central axis of rotation of said mandrel wheel means for causing preselected radial displacement of said mandrel spindle means relative said blanket wheel device whereby when said mandrel wheel means is in a rotated position associated with cylindrical container printing, and when said mandrel spindle is in a normal operating state wherein said mandrel spindle has a cylindrical container properly seated thereon, said mandrel spindle is positioned to urge said cylinder container into printing contact with said blanket wheel device; and whereby when said mandrel wheel means is in said rotated position associated with cylindrical container printing and when said mandrel spindle is in a skip-print operating state wherein said mandrel spindle does not have a cylindrical container properly seated thereon, said mandrel spindle is positioned in radially spaced apart, non-engaging relationship with said blanket wheel device; and f. control means for sensing the position of a can on an associated mandrel wheel and actuating said cam track means in response to the can position;

wherein said cam track means comprises:

a fixed track of relatively large circumferential extent having at least one fixed track cut-out portion of relatively small circumferential extent;

a moveable track positioned within said fixed track cut-out portion in operably mating relationship with said fixed track, said moveable track being radially displaceable relative said fixed track between a first position associated with said mandrel spindle normal operating state and a second position associated with said mandrel spindle skip-print operating state;

wherein said fixed track conprises a first cam follower engaging surface facing radially outwardly, a second cam follower engaging surface facing radially inwardly, a third cam follower engaging surface facing radially inwardly and a fourth cam follower engaging surface facing radially outwardly;

wherein said moveable track comprises a first cam follower engaging surface facing radially outwardly, a second cam follower engaging surface facing radially inwardly, a third cam follower engaging surface facing radially inwardly and a fourth cam follower engaging surface facing radially outwardly;

said first cam follower engaging surfaces of said fixed track and said moveable track being axially aligned and associated with a first cam follower;

said second cam follower engaging surfaces of said fixed track and said moveable track being axially aligned and associated with second cam follower;

said third cam follower engaging surfaces of said fixed track and said moveable track being axially aligned and associated with third cam follower;

said fourth cam follower engaging surfaces of said fixed track and said moveable track being axially aligned and associated with fourth cam follower;

said first and second cam followers being operably mounted on a first mandrel holder means;

said second and third cam followers being operably mounted on a second mandrel holder means;

wherein said first and second cam follower engaging surfaces of said moveable track are portions of a first C-shaped plate and wherein said third and fourth cam follower engaging surfaces of said moveable track are portions of a second C-shaped plate; said second C-shaped plate being mounted within said first C-shaped plate and radially displaceable relative thereto.

5. The invention of claim 4 wherein opposite circumferential ends of said moveable track overlappingly interfaces with said fixed track.

6. The invention of claim 5 wherein each of said cam follower engaging surfaces on said fixed track comprise circumferentially extending tab portions, each tab portion having an axial dimension substantially less than the axial dimension of the cam follower surface from which it projects;

and wherein each of said cam follower engaging surfaces of said moveable track comprises a tab portion positioned in axially offset, substantially circumferentially coextensive, immediately axially adjacent relationship with an associated tab portion of a circumferentially opposite cam engaging surface of said fixed track.

7. The invention of claim 5 wherein interfacing portions of said fixed track and said moveable track comprise intermeshing ramp means associated with each circumferentially opposite pair of cam follower engaging surfaces of said fixed track and said moveable track for providing a smooth transition surface therebetween.

8. The invention of claim 7 wherein each ramp means comprises a fixed track tab portion and an adjacent moveable track tab portion.

9. The invention of claim wherein one of said tab portions has a radially inclined surface and wherein the other of said tab portions has a surface substantially coplanar with the cam follower surface from which it projects.

10. The invention of claim 9 wherein the ramp means associated with said first cam follower engaging surfaces comprises:

a moveable track tab portion having a circumferentially extending surface substantially coplanar with the portion of the first cam follower engaging surface from which it projects; and a fixed track tab portion having a circumferentially extending surface sloping radially inwardly with respect to the first cam wheel engaging surface from which it projects;

wherein the ramp means associated with said second cam follower engaging surfaces comprises:

a fixed track tab portion having a circumferentially extending surface substantially coplanar with the portion of the second cam follower engaging surface from which it projects; and a moveable track tab portion having a circumferentially extending surface sloping radially outwardly with respect to the second cam wheel engaging surface from which it projects;

wherein the ramp means associated with said third cam follower engaging surfaces comprises:

a fixed track tab portion having a circumferentially extending surface substantially coplanar with the portion of the third cam follower engaging surface from which it projects; and a moveable track tab portion having a circumferentially extending surface sloping radially outwardly with respect to the third cam wheel engaging surface from which it projects;

wherein the ramp means associated with said fourth cam follower engaging surfaces comprises:

a moveable track tab portion having a circumferentially extending surface substantially coplanar with the portion of the fourth cam follower engaging surface from which it projects; and a fixed track tab portion having a circumferentially extending surface sloping radially inwardly with respect to the fourth cam wheel engaging surface from which it projects.

11. The invention of claim 5 comprising track movement means for radially moving said moveable track relative said fixed track comprising:

first roller means operably mounted in fixed relationship with said first C-shaped plate;

second roller means operably mounted in fixed relationship with said fixed track, and first wedge means operably mounted between said first and second roller means for selectively displacing said roller means one relative the other for causing radial displacement of said first C-shaped plate relative said fixed track;

third roller means operably mounted in fixed relationship with said second C-shaped plate;

fourth roller means operably mounted in fixed relationship with said fixed track, and second wedge means operably mounted between said third and fourth roller means for selectively displacing said roller means one relative the other for causing radial displacement of said second C-shaped plate relative said fixed track.

12. The invention of claim 11 comprising biasing means for urging said first and second roller means together and for urging said third and fourth roller means together.

13. The invention of claim 5 comprising stop means for limiting the amount of radial travel of said first C-shaped plate and said second C-shaped plate relative said fixed track.

14. The invention of claim 5 comprising guide and retension means for retaining said moveable track in axially fixed relationship relative said fixed track and for guiding said moveable track along a precise path during radial movement thereof relative said fixed track.

15. The invention of claim 14 wherein said guide and retension means comprises:

axially projecting radially extending key means for guiding the movement of said C-shaped plates projecting from a radially and circumferentially extending portion of said second C-shaped plate;

radially extending key slot means for guidingly engaging said key means provided in a radially and circumferentially extending portion of said first C-shaped plate;

circumferentially and radially extending wings having surface portions thereon in continuous coplanar relationship with said radially and circumferentially extending portion of said first C-shaped plate; and L-shaped bracket means fixedly mounted on said fixed track means and slidingly engaging said wings for preventing axial displacement of said first C-shaped plate relative said fixed track.

16. A mandrel assembly for use in a continuous printing machine for cylindrical containers comprising:

a. mandrel wheel means for supporting cylindrical container receiving apparatus thereon, said mandrel wheel means having a central axis of rotation positioned in parallel alignment with a central axis of rotation of an associated blanket wheel device carrying a printing medium on a circumferential portion thereof for printing on said cylindrical containers carried by said mandrel wheel means;

b. at least one mandrel holder means for supporting a mandrel spindle means thereon, pivotally mounted on a circumferential portion of said mandrel wheel means for pivotal movement about a mandrel holder pivot axis positioned substantially parallel to said mandrel wheel central axis of rotation;

c. elongate mandrel spindle means for supporting a cylindrical container on a peripheral surface thereof, rotatably mounted on said mandrel holder means for rotation about a central axis of rotation positioned in substantially parallel, non-coaxial relationship with said mandrel holder pivot axis whereby said mandrel spindle means is radially displaceable relative said central axis of rotation of said mandrel wheel means by pivotal movement of said mandrel holder means about said mandrel holder pivot axis;

d. cam follower means for following a cam track means, rotatably mounted on said mandrel holder means for rotation about a central axis of rotation positioned in substantially parallel, non-coaxial relationship with said mandrel holder pivot axis whereby said mandrel holder means is pivotally displaced about said mandrel holder means pivot axis by radial displacement of said cam follower means relative said central axis of rotation of said mandrel wheel means;

e. cam track means operably associated with said cam follower means for guiding said cam follower means and for causing preselected relative radial displacement thereof with respect to said central axis of rotation of said mandrel wheel means for causing preselected radial displacement of said mandrel spindle means relative said blanket wheel device whereby when said mandrel wheel means is in a rotated position associated with cylindrical container printing, and when said mandrel spindle is in a normal operating state wherein said mandrel spindle has a cylindrical container properly seated thereon, said mandrel spindle is positioned to urge said cylinder container into printing contact with said blanket wheel device; and whereby when said mandrel wheel means is in said rotated position associated with cylindrical container printing and when said mandrel spindle is in a skip-print operating state wherein said mandrel spindle does not have a cylindrical container properly seated thereon, said mandrel spindle is positioned in radially spaced apart, non-engaging relationship with said blanket wheel device; and f. control means for sensing the position of a can on an associated mandrel wheel and actuating said cam track means in response to the can position;

wherein said cam track means comprises a cam track printing portion thereon associated with movement of said mandrel spindle means into a proximate relationship with the blanket wheel device and wherein said cam track printing portion comprises:

printing path means for engaging said cam follower means in said normal operating state and for guiding said cam follower means to cause a printing engagement between the blanket wheel device and a container carried by said mandrel spindle; and skip-printing path means for engaging said cam wheel means in said skip-print operating state and for guiding said cam follower means to cause said mandrel spindle to be deflected away from printing engagement with the blanket wheel device;

wherein said printing path means and said skip-printing path means comprise operating surfaces which are radially displaceable with respect to one another;

wherein said cam track means comprises a substantially continuous, closed loop, cam follower engaging fixed track and a relatively short length cam follower engaging moveable track positioned in axially offset relationship with said fixed track, said moveable track being positioned within said cam track printing portion;

wherein said printing path means comprises one of said fixed track and said moveable track and wherein said skip-printing path means comprises the other of said fixed track and said moveable track;

said moveable track being axially spaced relative said fixed track, said cam follower means comprising a pair of coaxially mounted rollers, one roller being engageable with said fixed track, the other roller being engageable with said moveable track.

17. The invention of claim 16 wherein said mandrel assembly comprises at least two circumferentially adjacent mandrel holder means and associated mandrel spindle means and cam followers means comprising:

a first cam follower assembly mounted on one mandrel holder means having a first cam follower first roller and a first cam follower second roller and comprising a second cam follower assembly mounted on a second mandrel holding means having a second cam follower first roller and a second cam follower second roller;

said moveable track means comprising a first portion positioned next adjacent one radially extending side of said fixed track and a second portion positioned next adjacent said fixed track next adjacent the other radially extending side thereof;

said moveable track portions being independently radially displaceable;

said first moveable track portion being engageable with said first cam follower assembly first wheel;

said second moveable track portion being engageable with said second cam follower assembly first wheel;

said fixed track being engageable with said first cam follower assembly second wheel and said second cam follower assembly second wheel;

whereby each said cam follower assembly is associated with the same fixed track and a separate moveable track portion whereby each cam follower assembly is independently actuateable whereby one moveable track portion may be actuated during a period that the associated moveable track portion is being reset for accommodated high speed machine operation.

18. A mandrel assembly for use in a continuous printing machine for cylindrical containers comprising:

a. mandrel wheel means for supporting cylindrical container receiving apparatus thereon, said mandrel wheel means having a central axis of rotation positioned in parallel alignment with a central axis of rotation of an associated blanket wheel device carrying a printing medium on a circumferential portion thereof for printing on said cylindrical containers carried by said mandrel wheel means;

b. at least one mandrel holder means for supporting a mandrel spindle means thereon, pivotally mounted on a circumferential portion of said mandrel wheel means for pivotal movement about a mandrel holder pivot axis positioned substantially parallel to said mandrel wheel central axis of rotation;

c. elongate mandrel spindle means for supporting a cylindrical container on a peripheral surface thereof, rotatably mounted on said mandrel holder means for rotation about a central axis of rotation positioned in substantially parallel, non-coaxial relationship with said mandrel holder pivot axis whereby said mandrel spindle means is radially displaceable relative said central axis of rotation of said mandrel wheel means by pivotal movement of said mandrel holder means about said mandrel holder pivot axis;

d. cam follower means for following a cam track means, rotatably mounted on said mandrel holder means for rotation about a central axis of rotation positioned in substantially parallel, non-coaxial relationship with said mandrel holder pivot axis whereby said mandrel holder means is pivotally displaced about said mandrel holder means pivot axis by radial displacement of said cam follower means relative said central axis of rotation of said mandrel wheel means;

e. cam track means operably associated with said cam follower means for guiding said cam follower means and for causing preselected relative radial displacement thereof with respect to said central axis of rotation of said mandrel wheel means for causing preselected radial displacement of said mandrel spindle means relative said blanket wheel device whereby when said mandrel wheel means is in a rotated position associated with cylindrical container printing, and when said mandrel spindle is in a normal operating state wherein said mandrel spindle has a cylindrical container properly seated thereon, said mandrel spindle is positioned to urge said cylinder container into printing contact with said blanket wheel device; and whereby when said mandrel wheel means is in said rotated position associated with cylindrical container printing and when said mandrel spindle is in a skip-print operating state wherein said mandrel spindle does not have a cylindrical container properly seated thereon, said mandrel spindle is positioned in radially spaced apart, non-engaging relationship with said blanket wheel device; and f. control means for sensing the position of a can on an associated mandrel wheel and actuating said cam track means in response to the can position; wherein said cam track means comprises:

a fixed track of relatively large circumferential extent having at least one fixed track cut-out portion of relatively small circumferential extent;

a moveable track positioned within said fixed track cut-out portion in operably mating relationship with said fixed track, said moveable track being radially displaceable relative said fixed track between a first position associated with said said mandrel spindle normal operating state and a second position associated with said mandrel spindle skip-print operating state;

wherein said cam follower means comprises an associated cam follower pair comprising a first cam follower and a second cam follower having parallel axes of rotation and being fixed in radially spaced apart relationship;

wherein said cam track means comprises a first continuous loop having a radially outwardly positioned surface for receiving said first cam follower in rolling engagement thereon and a radially inwardly positioned surface for accepting said second cam follower in rolling engagement thereon.

19. The invention of claim 18 wherein alternating mandrel holder means comprise axially offset cam follower means and further comprising:

a second continuous loop substantially identical to said first continuous loop and positioned axially adjacent said first loop;

said first loop receiving cam follower means associated with a first mandrel holder means said second loop receiving cam follower means associated with a second mandrel holder means thereon, said second mandrel holder means being positioned immediately succeeding relationship with said first mandrel holder means;

said first continuous loop comprising a first moveable portion engaged by a first axially extending member;

said second continuous loop comprising a second moveable portion axially adjacent said first moveable portion engaged by a second radially extending member which is circumscribed by said first axially extending member and which is radially deflectable therewith whereby said first track and said second track moveable portions are independently radially deflectable by radial movement of an associated axial member.

* * * * *